US006602009B2

(12) United States Patent
Sodeyama

(10) Patent No.: US 6,602,009 B2
(45) Date of Patent: Aug. 5, 2003

(54) TAPE CUTTING MECHANISM FOR TAPE PRINTING APPARATUS

(75) Inventor: Hideo Sodeyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/141,524

(22) Filed: May 7, 2002

(65) Prior Publication Data

US 2002/0181993 A1 Dec. 5, 2002

(30) Foreign Application Priority Data

May 25, 2001 (JP) ..... 2001-156383

(51) Int. Cl.[7] ..... B41J 11/66
(52) U.S. Cl. ..... 400/621; 400/88; 101/93.07
(58) Field of Search ..... 400/621, 621.1, 400/88, 593; 101/93.07

(56) References Cited

U.S. PATENT DOCUMENTS 5,348,406 A * 9/1994 Yoshiaki et al. ..... 400/615.2
5,441,352 A * 8/1995 Shiota ..... 400/621
5,447,383 A * 9/1995 Hirono et al. ..... 400/621
5,676,478 A * 10/1997 Bowman et al. ..... 400/621
5,913,624 A * 6/1999 Ikegami ..... 400/621
6,030,135 A * 2/2000 Imai ..... 400/621
6,113,293 A * 9/2000 Schanke et al. ..... 400/621

FOREIGN PATENT DOCUMENTS

JP 2-36450 3/1990

* cited by examiner

*Primary Examiner*—Daniel J. Colilla
*Assistant Examiner*—Dave A. Ghatt
(74) *Attorney, Agent, or Firm*—Hogan & Hartson, LLP

(57) ABSTRACT

There is provided a tape cutting mechanism for a tape printing apparatus, which allows a user to operate a manual operation lever while holding the apparatus casing in his hands, with an excellent operability, and thereby enabling a tape-shaped member to be cut efficiently. A cutter is disposed to face a tape exit for cutting the tape-shaped member from a direction orthogonal thereto the tape-shaped member. A manual operation lever is pivotally supported in the rear corner portion of the casing, for causing the cutter to perform cutting operation, and extends from a rear end serving as a center of pivotal motion thereof to a front end serving as a force point to which a force is manually applied by the lever operation, in a manner bent frontward, along the casing. A pivot arm extends from one end for being engaged with an input portion of the cutter to another end serving as a center of pivotal motion thereof, in a direction substantially orthogonal to a direction of cutting operation of the cutter. The manual operation lever has an urging portion formed at an intermediate portion thereof, for abutting on an intermediate portion of the pivot arm and serving as a point of action for pivotally moving the pivot arm.

9 Claims, 15 Drawing Sheets

TAPE CUTTING MECHANISM FOR TAPE PRINTING APPARATUS

BACKGROUND OF THE INVENTION

1. Field of the Invention

This invention relates to a tape cutting mechanism for a tape printing apparatus, which is capable of cutting off a printed portion of a tape-shaped member sent out via a tape exit in response to a manual lever operation.

2. Prior Art

Conventionally, a tape cutting mechanism of this kind for a tape printing apparatus was proposed e.g. in Japanese Laid-Open Utility Model Publication (Kokai) No. 2-36450. This tape cutting mechanism includes a cutter holder having a hollow cylindrical shape and rotatably disposed for supporting a cutter blade, and a manual operation lever pivotally supported at a location close to a rotational axis of the cutter holder, for pivotal motion about a pivotal axis thereof. The cutter holder and the manual operation lever are arranged in the vicinity of a tape exit in a state mated with each other at a location close to their respective rotational and pivotal axes. Further, the cutter blade is supported in a state directed in the direction of a tangential line to the cutter holder, and constructed such that the cutter blade can cut through a tape-shaped member being sent out from the tape exit, from an orthogonal direction thereto. The manual operation lever largely protrudes outward from the apparatus, and when operated manually, the cutter holder is rotated via the mated portion to cause the cutter blade to perform a circular motion, whereby the tape-shaped member is cut through by force-cutting from the orthogonal direction.

In the conventional tape cutting mechanism constructed as above, since the tape-shaped member is cut through by a circular motion of the cutter blade, a component force is applied in a direction of rotation thereof as will entangle the tape-shaped member during cutting. As a result, a force from the manual operation lever is relieved although in a small amount. Therefore, a cutting force larger than necessary is required, and load is applied to the cutter blade as well, as reaction to the component force, so that the cutter blade is liable to be damaged as it is used over a longer time period. Further, although the manual operation lever, which largely protrudes out of the apparatus, can be easily operated by a small stroke, the apparatus is increase in size as a whole. If the manual operation lever is reduced in the amount of projection to decrease the size of the apparatus, however, sufficient stroke cannot be secured, so that the operation of the manual operation lever requires an increased force, thereby degrading the operability of the manual operation lever.

Recently, there is a demand for a tape printing apparatus of a small-sized handy type which allows the user to perform manual key operations, and a manual lever operation for cutting tape-shaped members while holding the apparatus with his hands. In this case, in view of the conventional construction of the tape cutting mechanism, it is considered very difficult to arrange both of an input portion of a cutter to which a force is applied for cutting operation of the cutter and a pivot of the manual operation lever in the vicinity of the tape exit, while ensuring the operability of the manual operation lever and reducing the size of the apparatus, and what is more, preventing a component force from being applied to the tape-shaped member.

SUMMARY OF THE INVENTION

It is an object of the invention to a tape cutting mechanism for a tape printing apparatus, which allows a user to operate a manual operation lever while holding the apparatus casing in his hands, with an excellent operability, thereby enabling a tape-shaped member to be cut efficiently.

To attain the above object, the present invention provides a tape cutting mechanism for a tape printing apparatus including a casing having a rear side surface, a rear corner portion, and a tape exit formed through the rear side surface, the tape cutting mechanism cutting off a printed portion of a tape-shaped member sent out via the tape exit, in response to a lever operation carried out in a state of the casing being held by hand.

The tape cutting mechanism according to the invention is characterized by comprising:

a cutter disposed to face the tape exit, for cutting the tape-shaped member from a direction orthogonal thereto, the cutter having an input portion for receiving a force applied thereto;

a manual operation lever pivotally supported in the rear corner portion of the casing, for causing the cutter to perform cutting operation, the manual operation lever having a rear end serving as a center of pivotal motion thereof, a front end serving as a force point to which a force is manually applied by the lever operation, and an intermediate portion located between the rear end and the front end, and extending along the casing from the rear end to the front end in a manner bent frontward; and a pivot arm having one end for being engaged with the input portion of the cutter, another end serving as a center of pivotal motion thereof, and an intermediate portion located between the one end and the another end, and extending from the one end to the another end in a direction substantially orthogonal to a direction of cutting operation of the cutter, and wherein the manual operation lever has an urging portion formed at the intermediate portion thereof, for abutting on the intermediate portion of the pivot arm and serving as a point of action for pivotally moving the pivot arm.

According to this tape cutting mechanism, when the manual operation lever is manually operated for pivotal motion by the front end portion thereof, the urging portion of the intermediate portion thereof abuts against the pivot arm to urge the same, whereby the pivot arm is pivotally moved about the other end thereof in a direction opposite to the direction of rotation of the pivotal motion of the manual operation lever. This causes the one end of the pivot arm to be engaged with the input portion of the cutter to transmit a force to the cutter for causing the same to perform a cutting operation. The cutter cuts through the tape-shaped member from a direction orthogonal to the tape-shaped member. The pivotal arm which serves as a driving force-transmitting system is interposed between the manual operation lever and the cutter, and hence even if a pivot of the manual operation lever and the input portion of the cutter are arranged close to the tape exit, it is possible to cut through the tape-shaped member from a truly orthogonal direction, thereby preventing a component force from being applied to the tape-shape member during cutting thereof. As a result, load applied to the cutter as a reaction can be reduced, thereby making it possible to enhance the durability of a blade of the cutter as well as to cut a printed tape to form a neat cut end face.

Further, since the intermediate portion of the pivot arm is pressed on by the intermediate portion of the manual operation lever by making use of the principles of the lever and fulcrum, it is possible to transmit the operating force applied to the manual operation lever to the input portion of the cutter with least reduction of the force, thereby directly applying the force to the cutter for the cutting operation thereof. Further, since the manual operation lever extends along the casing, it is possible to effectively arrange the manual operation lever to improve operability thereof and make the whole tape printing apparatus compact in size.

Preferably, the manual operation lever is bent such that the manual lever can be pivotally moved inwardly toward the casing by the force manually applied to the front end thereof.

According to this preferred embodiment, the lever operation of the manual operation lever can be ergonomically facilitated. More specifically, the manual operation lever may be configured such that the lever can be moved inwardly toward the casing, for a clockwise pivotal motion when it is designed to be operated by a finger of a user's right hand, or for a counterclockwise pivotal motion when it is designed to be operated by a finger of a user's left hand. This makes it possible to further enhance the operability of the manual operation lever.

Preferably, the tape cutting mechanism further includes a stopper against which the front end of the manual operation lever abuts when the cutter has reached a position at which the cutting operation is completed.

According to this preferred embodiment, the range of pivotal operation of the manual operation lever is limited, whereby the user can recognize by his sense that the tape-shaped member has been cut through. This prevents the lever from being pivotally moved than necessary, so that it is possible to enhance the operability and ease of handling of the lever, and further prevent damage of the operation lever itself due to pivotally moving operations. Although the casing may also play the role of the stopper, it is preferred that the stopper is formed as part of a frame of the tape printing apparatus, inside the casing.

Preferably, the cutter includes a cutter blade that is slid to cut through the tape-shaped member, and a cutter holder having one end having a holding portion for holding the cutter blade, and another end having the input portion engaged with the pivot arm, the cutter holder being configured such that the cutter holder can be slid in the direction of cutting operation.

According to this preferred embodiment, responsive to a force from the pivot arm, the cutter holder is slidingly moved in the direction of cutting operation, and the cutter blade held at the one end thereof cuts the tape-shaped member by force-cutting. This makes it possible to transmit the force to the cutter by a simple construction as well as to cut the tape-shaped member linearly. Further, since the cutter blade is a single blade, it is possible to reduce the number of components and the manufacturing costs of the whole tape printing apparatus. It should be noted that preferably, the cutter blade is constructed by an oblique blade whose cutting edge is slanted relative to the direction of sliding of the cutter. According to this construction, it is possible to reduce an area of contact between the cutter blade and the tape-shaped member to decrease the push-cutting force required for cutting operation and further enhance the durability of the cutter blade.

Preferably, the tape-shaped member is sent in a vertical attitude in which the tape-shaped member has a direction of width thereof set to a vertical direction, and the one end of the cutter holder has an upper end portion and a lower end portion at least one of which has resilience, the holding portion of the cutter holder comprising upper support portions formed on the upper end portion on respective front and rear surface sides of the cutter blade alternately along the direction of cutting operation, for holding an upper end of the cutter blade alternately from the front and rear surface sides thereof along the direction of cutting operation, and lower support portions formed on the lower end portion on the respective front and rear surface sides of the cutter blade alternately along the direction of cutting operation, for holding a lower end of the cutter blade alternately from the front and rear surface sides thereof along the direction of cutting operation, the holding portion resiliently holding the cutter blade vertically between the upper end portion and the lower end portion.

According to this preferred embodiment, the cutter blade is held from the front and rear side thereof such that the upper and lower end portions thereof are sandwiched alternately in the direction of cutting operation, which makes it possible to prevent cutting operation from causing vertical deflection of the cutter blade. Further, at the same time, the cutter blade is resiliently held by the cutter holder, so that the cutter blade can be easily attached to the cuter holder, and even when the cutter blade is worn or damaged, it can be easily replaced with a new one.

Preferably, the cutter holder further includes a cutter face-receiving portion which connects a proximal end portion of the upper end portion and a proximal end portion of the lower end portion to each other, and at the same time receives one of the front and rear side surfaces of the cutter blade.

According to this preferred embodiment, it is possible not only to facilitate mounting of the cutter blade by using the cutter face-receiving portion but also to prevent lateral deflection of the cutter blade during cutting operation. Therefore, even a thick tape-shaped member can be linearly cut through with stability. Further, it is preferred that part of the cutter face-receiving member is cut away to slant the same with respect to the direction of extension thereof, thereby imparting resilience to at least one of the upper support portions and the lower support portions.

Preferably, the casing has an abutment portion formed in a manner opposed to the cutter blade, and the tape cutting mechanism further includes a tape-retaining member that is slid in the direction of cutting operation in a manner interlocked with the lever operation of the manual operation lever to hold the tape-shaped member between the tape-retaining member and the abutment portion of the casing prior to an advancing operation of the cutter blade for cutting through the tape-shaped member, the tape-retaining member moving away from the abutment portion subsequent to a returning operation of the cutter blade for moving away from the tape-shaped member.

According to this preferred embodiment, when cutting operation is started, the tape-retaining member is slid in a manner interlocked with the lever operation of the manual operation lever, to hold the tape-shaped member between the same and the abutment portion prior to the advancing operation of the cutter for cutting through the tape-shaped member. Then, the cutter is slidingly moved to cut through the tape-shaped member. Further, after completion of the cutting operation, the cutter starts returning operation in advance of that of the tape-retaining member. This makes it possible to suppress deflection of the tape-shaped member caused by the cutting operation of the cutter to thereby allow the cutter to cut through the tape-shaped member with stability.

Preferably, the tape-retaining member is supported in a manner slidable relative to the cutter holder in a state urged toward the abutment portion.

According to this preferred embodiment, it is possible to simplify the construction of the cutter and component parts associated therewith to cause the tape-retaining member to be interlocked with the manual operation lever. More specifically, when the manual operation lever is operated, the tape-retaining member is slid to hold the tape-shaped member between the same and the cutter holder. Then, the cutter holder is further slid in the direction of cutting operation in a manner compressing the spring interposed between the same and the tape-retaining member, to cause the cutter blade to start cutting into the tape-shaped member.

Preferably, the tape-retaining member is arranged at a location downstream with respect to a direction of feed of the tape-shaped member, and outward of the cutter blade.

According to this preferred embodiment, the tape-shaped member is cut, at a position inward of a flutterable portion thereof downstream of the cutter blade, with the flutterable portion being retained, which enables the tape-shaped member to be linearly cut with increased stability. Further, since the cutter blade is protected from external access by the tape-retaining member, consistently from the start of the cutting operation to the completion thereof, it is also possible to enhance the safety of the tape exit and its vicinity.

The above and other objects, features, and advantages of the invention will become more apparent from the following detailed description taken in conjunction with the accompanying drawings.

DETAILED DESCRIPTION OF PREFERRED EMBODIMENTS

The invention will now be described in detail with reference to the drawings showing a tape cutting mechanism for a tape printing apparatus, according to an embodiment thereof. The tape printing apparatus has a cartridge accommodating a printing tape which is a tape-shaped member, removably mounted therein, prints desired letters, figures, and the like on the printing tape while drawing the tape from the tape cartridge, and cuts off a printed portion of the tape to a predetermined length by the tape cutting mechanism, thereby producing a label. Further, the tape printing apparatus is of a handy type small in size which is configured to allow a user to perform key operations for inputting desired letters and so forth, and a lever operation for cutting through the printing tape, while holding the apparatus in his hands.

Figure 1:
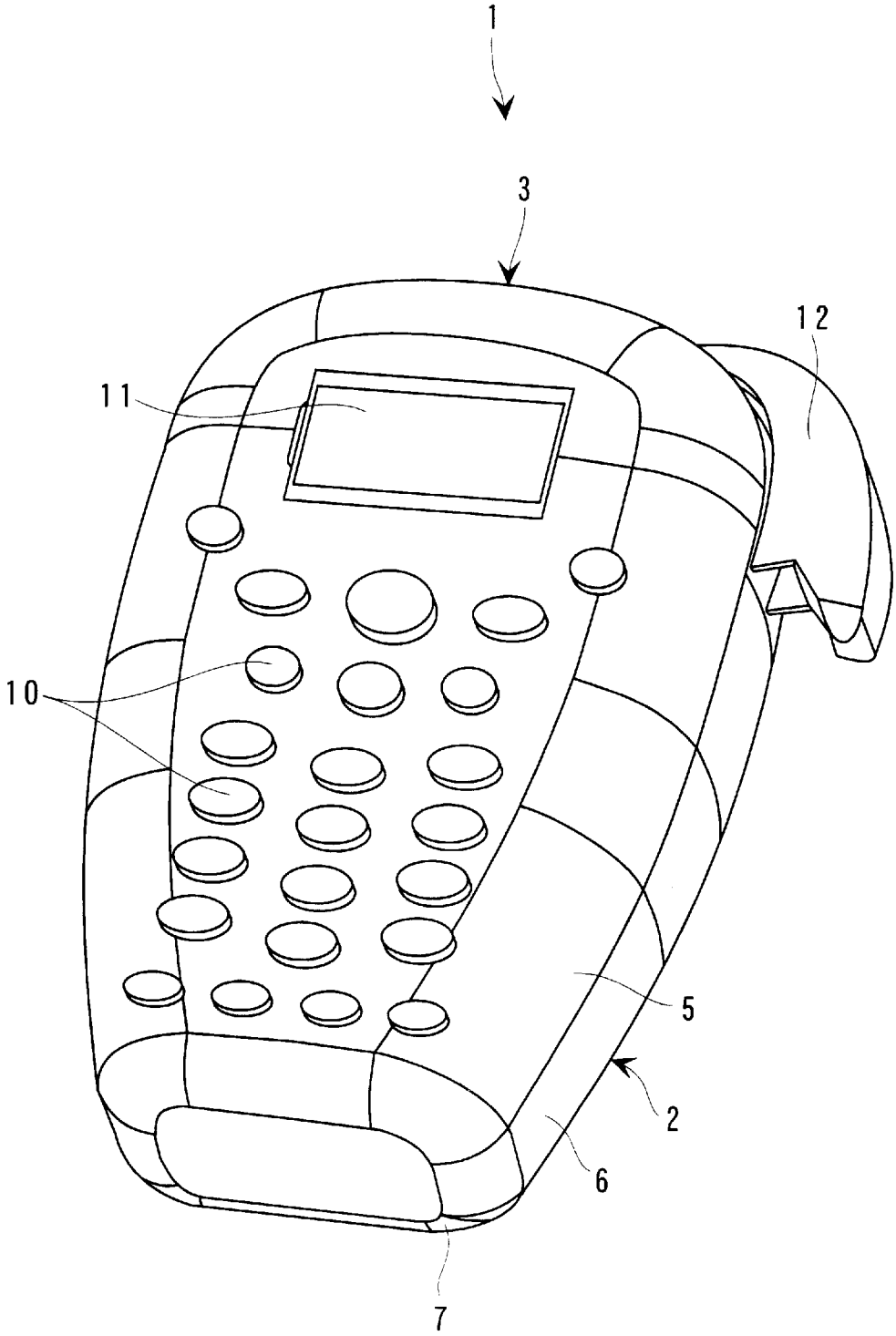
FIG. 1 is a perspective view of the appearance of a tape printing apparatus incorporating a tape cutting mechanism according to an embodiment of the invention.
Figure 2:
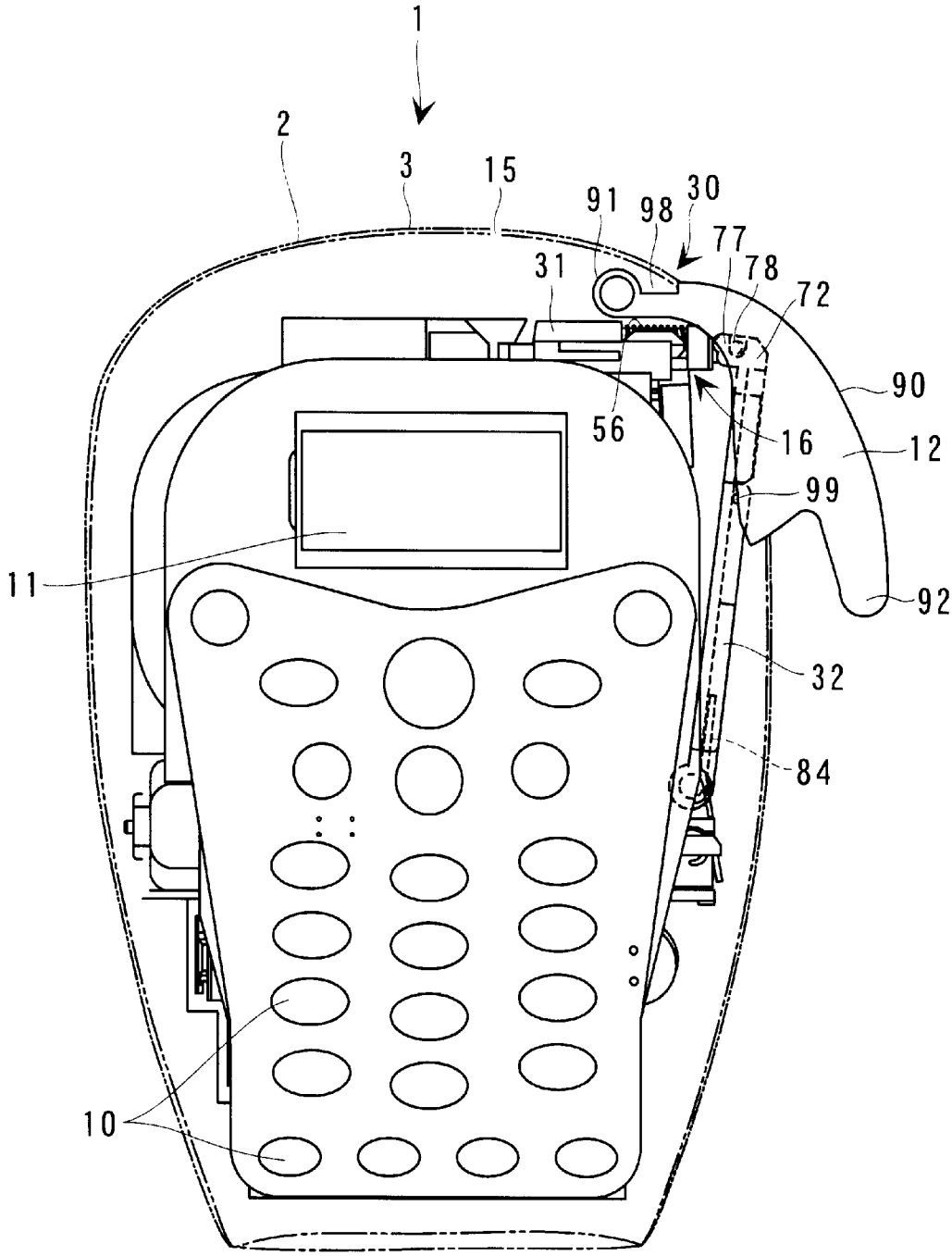
FIG. 2 is a plan view of the tape printing apparatus with a casing thereof omitted, as viewed from a top side.
Figure 3:
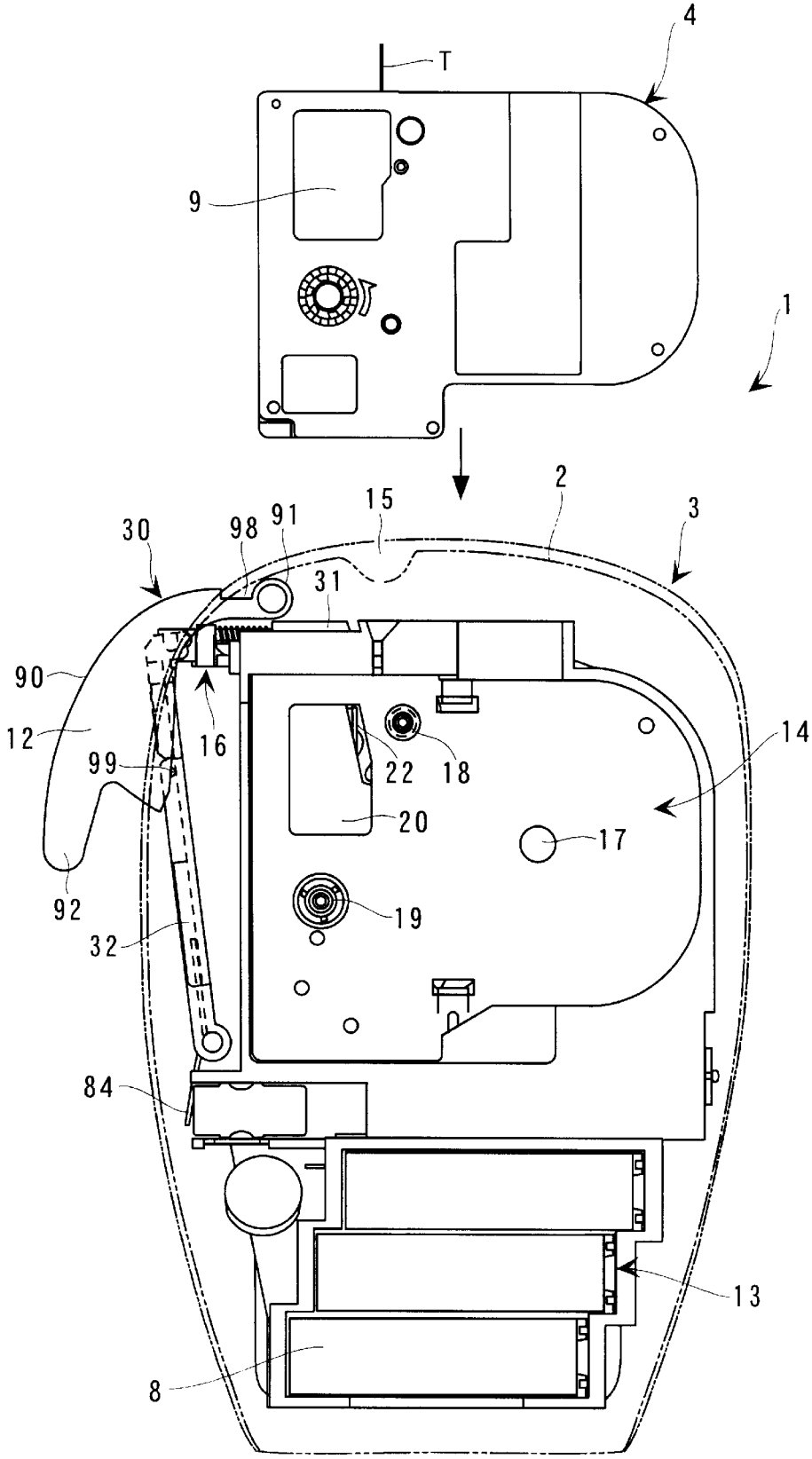
FIG. 3 is a bottom view of the tape printing apparatus with the casing thereof omitted, as viewed from a bottom side.

Now, the tape printing apparatus will be described hereinafter with reference to FIGS. 1 to 3. FIG. 1 is a perspective view of the appearance of the whole tape printing apparatus. FIG. 2 is a plan view of the tape printing apparatus with a casing thereof omitted, as viewed from a top side. FIG. 3 is a bottom view of the tape printing apparatus with the casing thereof omitted similarly to FIG. 2, as viewed from a bottom side. As shown in the figures, the tape printing apparatus 1 is comprised of a main unit 3 having a casing 2 forming an outer shell thereof, and the tape cartridge 4 removably mounted in the main unit 3. A printing tape T with a peel-off paper, which is a print medium, is accommodated in the tape cartridge 4 such that the printing tape T can be rolled out from the cartridge 4.

The casing 2 is egg-shaped as a whole in plan view, and comprised of an upper casing 5 forming a top of the casing 2, an intermediate casing 6 welded to the upper casing 5 to form an intermediate portion of the casing 2, and a lower casing 7 forming a bottom of the casing 2. The lower casing 7 is constructed such that it can be removed from the intermediate casing 6, and used as a lid which is opened and closed for mounting or removing the tape cartridge 4 and batteries 8 in or from the casing 2 from below.

The main unit 3 has a keyboard 10 comprised of a plurality of keys as input means arranged on the top of the casing 2 over a wide area thereof, and a display 11 arranged on a rear portion of the keyboard 10, for displaying information, such as letters and the like. Further, the casing 2 has a manual operation lever 12 attached to a right-side rear portion thereof such that the manual operation lever 12 protrudes outward from the casing 2 and extends forward in a manner bent along a right-side surface of the casing 2. Further, the lower casing 7 of the main unit 3 has an inside thereof formed with a battery-accommodating section 13 arranged toward a front side thereof, for accommodating three batteries 8 at different levels, and a cartridge-mounting section 14 arranged toward a rear side thereof, for removably receiving the tape cartridge 4 therein.

Further, the casing 2 has a tape exit 15 in the form of a slit formed through an intermediate portion of a rear side wall thereof such that the tape exit 15 vertically extends for sending a printed portion of the printing tape T out of the apparatus. The tape exit 15 and the cartridge-mounting section 14 are in communication with each other, and a cutter 16 is arranged therebetween in a manner facing toward the tape exit 15. By operating the manual operation lever 12, the cutter 16 is caused to perform cutting operation to cut through the printing tape T to a predetermined length whereby a label is produced. The manual operation lever 12, the cutter 16, a tape-retaining member 31, referred to hereinafter, and a pivot arm 32, referred to hereinafter, form a tape cutting mechanism 30, referred to hereinafter.

The main unit 3 is configured to have a predetermined thickness as a whole and a reduced size so as to allow to a user to carry with ease by holding the same in his hand. During use of the tape printing apparatus 1, the user operates keys on the keyboard 10 e.g. by the thumbs of his both hands while holding the main unit 3 in his both hands in an enclosing manner, to thereby input desired letters and the like. Further, in cutting through the printing tape T after completion of printing, the user operates the manual operation lever 12 with a forefinger or middle finger of the user's right hand to the cause the lever 12 to be pivoted inwardly toward the casing 2, while holding the main unit 3 by hand as described above.

Figure 5:
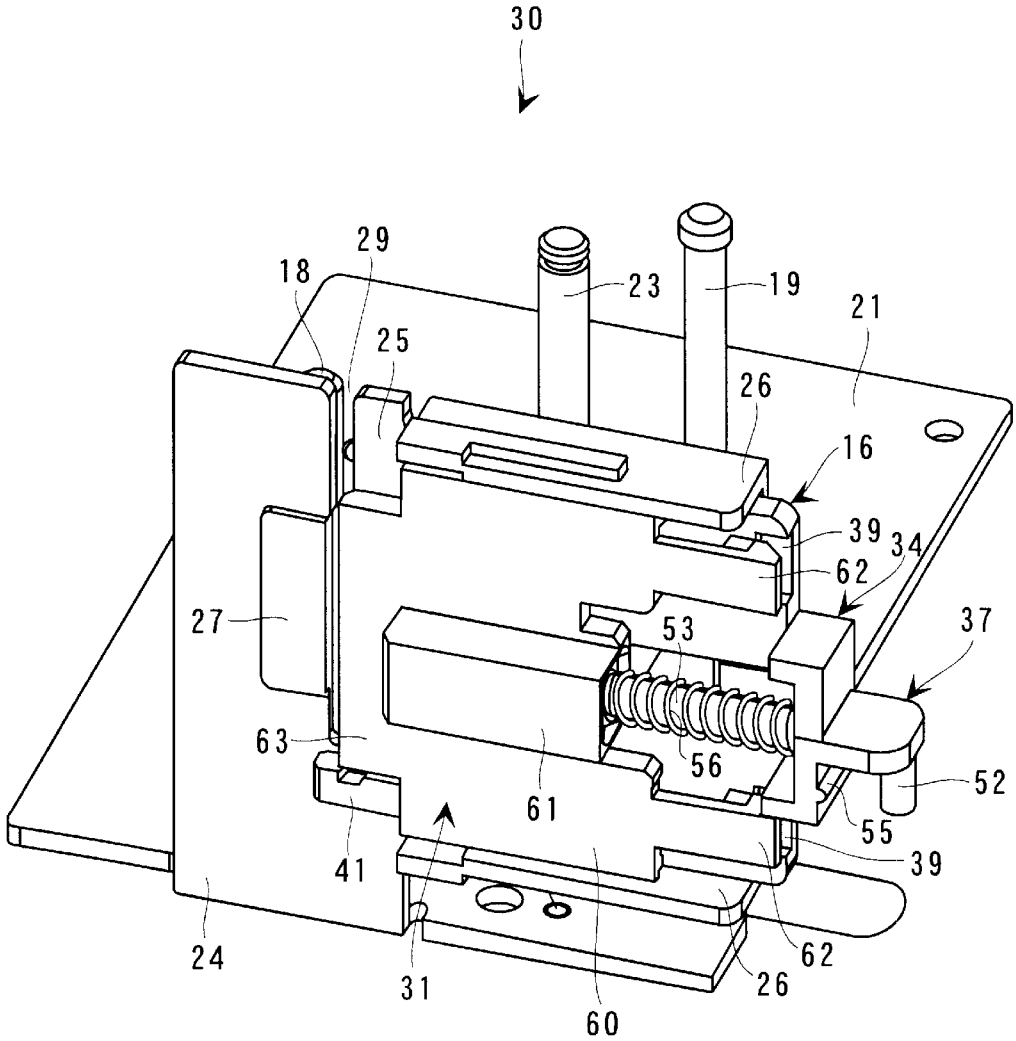
FIG. 5 is a perspective view showing the structure of a cutter and component parts associated therewith of the tape cutting mechanism.

Referring to FIG. 3, the cartridge-mounting section 14 facing downward has a guide projection 17 arranged in a central left portion thereof for guiding the tape cartridge 4 in the main unit 3 when it is mounted therein, a platen drive shaft 18 and a ribbon take-up shaft 19 each for supplying a driving force to driven portions of the tape cartridge 4, and a head unit 20 with a print head 22, arranged in a manner opposed to the platen drive shaft 18, all of which extend perpendicularly downward from the cartridge-mounting section 14. Arranged in a space above the cartridge-mounting section 14 is a base frame 21 which supports thereon a tape feed mechanism, not shown, including a motor for rotating the platen drive shaft 18 and the ribbon take-up shaft 19, and slidably supports the cutter 16 and the tape-retaining member 31 (which will be described in detail hereinafter with reference to FIG. 5).

The tape cartridge 4 carries thereon not only a printing tape T but also an ink ribbon, not shown, which is sent along the direction of the length thereof in a vertical attitude in which the direction of the width thereof is set to a vertical direction, a platen for engagement with the platen drive shaft 18, etc. Further, formed in the vicinity of the platen is a head opening 9 in which the print head 22 on the main unit side is fitted. The ink ribbon is fed or run together with the printing tape T in a state overlaid thereon when it passes the platen (print head 22), and then taken up by the ribbon take-up reel. On the other hand, the printing tape T passes through a slit formed in a side wall of a casing of the tape cartridge 4, followed by being delivered out via the tape exit 15. It should be noted that there are four types of the tape cartridge 4 accommodating different types of the printing tape T having respective widths of 6 mm, 9 mm, 12 mm, and 18 mm.

When the tape printing apparatus 1 is used by the user, first, the main unit 3 is inverted upside down to remove the lower casing 7 from the main unit 3, and the tape cartridge 4 is mounted in the cartridge-mounting section 14. After the tape cartridge 4 has been mounted in the cartridge-mounting section 14, a leading end of the tape T unrolled from the tape cartridge 4, and the ink ribbon are inserted between the platen and the print head 22, and at the same time the platen and the ribbon take-up reel are engaged with the platen drive shaft 18 and the ribbon take-up shaft 19, respectively. Then, when the lower casing 7 is attached to the intermediate casing 6, the print head 22 is pivotally moved to abut against the platen in a manner sandwiching the printing tape T and the ink ribbon therebetween, followed by placing the tape printing apparatus 1 in a printing wait state (which will be described in detail hereinafter).

Next, the main unit 3 is inverted upside down, and the apparatus is made ready for entry operation with the main unit 3 held in the user's hands. At this time, the power is turned on by depressing a power key, and the keyboard 10 is operated while viewing the display 11 to input information of the type of the tape cartridge 4 mounted in the apparatus in the first place. After recognition of the type of the tape cartridge 4, the keyboard 10 is operated to input and edit desired letters and the like. Then, execution of printing is instructed.

After execution of printing is instructed, the printing tape T and the ink ribbon are simultaneously fed, and the print head 22 is driven for heating as required, whereby ink coated on the ink ribbon is thermally transferred to print on the printing tape T. After being used for printing, the ink ribbon is taken up within the tape cartridge 4, whereas the printing tape T is sent out through the tape exit 15. The stop of feeding of the printing tape T is awaited, and when the user operates the manual operation lever 12, a printed portion of the printing tape T is cut off. As described in detail hereinafter, in an actual cutting operation for cutting through the printing tape T, the tape-retaining member 31 is slid to hold or retain the printing tape T, and then a printed portion of the printing tape T is cut off by the cutter 16 which is slid subsequent to the sliding operation of the tape-retaining member 31.

Now, the above-mentioned tape cutting mechanism 30 will be described with reference to FIGS. 2 to 11. Although in some of the figures, the tape cutting mechanism 30 is illustrated in a manner inverted upside down, in the following description, upward and downward directions and leftward and rightward directions are defined with reference to those in FIG. 1. As shown in FIGS. 2 to 5, the tape cutting mechanism 30 is comprised of the cutter 16 which faces toward the tape exit 15 and is capable of sliding in the leftward and rightward directions, the tape-retaining member 31 which is arranged behind the cutter 16 in an overlapping manner so as to be slid therewith, the manual operation lever 12 which causes the cutter 16 to perform a cutting operation, and the pivot arm 32 which is interposed between the manual operation lever 12 and the cutter 16. In the tape cutting mechanism 30, the pivot arm 32 is pivotally moved by operation of the manual operation lever 12, and the cutter 16 and the tape-retaining member 31 is slid by the pivot arm 32, whereby the printing tape T retained by the tape-retaining member 31 is cut in a push-cutting manner.

Next, the construction of the cutter 16 and component parts associated therewith will be described with reference to FIGS. 5 to 9C. The tape cutting mechanism 30 is supported by a cutter-supporting frame 24. The cutter-supporting frame 24 is formed by bending a rear portion of a base frame 21 having a head-supporting shaft 23 for pivotally supporting the print head 22 and the platen drive shaft 18 each extending perpendicularly upward therefrom. The cutter-supporting frame 24 is comprised of a vertically extending perpendicular plate portion 25, and a pair of slide supporting plate portions 26, 26 which are formed in a vertically spaced arrangement by bending upper and lower end portions of the perpendicular plate portion 25 backward into a horizontal direction.

The perpendicular plate portion 25 has an intermediate portion formed with a vertical passing slit 29 linearly continuous with the tape exit 15 and the slit of the tape cartridge 4. The printing tape T passes through the passing slit 29. Further, at a location forward of and spaced from the passing slit 29 of the perpendicular plate portion 25, there is formed (in a half-embossed manner) a raised portion 27 for guiding a cutter blade 33, referred to hereinafter, which has cut into the printing tape T, in a state in contact therewith.

This reduces a gap between the passing slit 29 (perpendicular plate portion 25) and the cutter blade 33, whereby a shearing force of the cutter blade 33 effectively acts on the printing tape T, to perform a stable cutting operation.

The pair of slide supporting plate portions 26, 26 of the cutter-supporting frame 24 have insides thereof formed with guide grooves 28, 28, respectively. The tape-retaining member 31 supported by the pair of upper and lower slide supporting plate portions 26, 26 in a manner sandwiched thereby is guided by the guide grooves 28, 28 to be slid in leftward and rightward directions. Further, the cutter 16 is slidably supported by the pair of slide supporting plate portions 26, 26 such that it can be slid along the slide supporting plate portions 26, 26, in a state engaged with the tape-retaining member 31 (which will be described in detail hereinafter).

As shown in FIGS. 7 to 9C, the cutter 16 is comprised of the cutter blade 33 in the form of a parallelogram with one oblique side thereof corresponding to a cutting edge, and a cutter holder 34 for holding the cutter blade 33 on a distal end side thereof in a state removably mounted thereto. The cutter 16 is slidably supported by the cutter-supporting frame 24 via the cutter holder 34. The cutter blade 33 is formed by a double-sided oblique blade whose cutting edge is slanted relative to the direction of sliding of the cutter 16 and the direction of the width of the printing tape T, and faces toward the passing slit 29. In this embodiment, the cutter 33 is configured such that an angle $\alpha$ of slanting thereof is 65 degrees although the optimum angle $\alpha$ depends on the amount of stroke of the manual operation lever 12.

The cutter holder 34 is comprised of a holder body 35 which is a main component thereof, a holding portion 36 which is formed by a pair of an upper support portion 41 (upper end portion) and a lower support portion 42 (lower end portion) extending forward from upper and lower end portions of the holder body 35 in the sliding direction (direction of cutting operation of the cutter 16), and an input portion 37 protruding backward from an intermediate portion of the rear end of the holder body 35 in the sliding direction. Further, the holder body 35 has a cutter face-receiving member 38 integrally formed therein in a manner connecting proximal end portions of the pair of support portions 41, 42 to each other, by cutting away a portion of the holder body 35 on a front surface side thereof corresponding to a side surface of the cutter blade 33 by a depth corresponding to the thickness of the cutter blade 33.

The pair of support portions 41, 42 of the holding portion 36 are constituted by the upper support portion 41 (upper end portion) extending a longer distance from the upper end portion of the holder body 35, and the lower support portion 42 (lower end portion) extending a shorter distance from the lower end portion of the holder body 35. The upper support portion 41 has an inside of the distal end portion thereof formed with a retaining portion 43 for preventing the cutter blade 33 from falling off the holding portion 36. Further, backward from the retaining portion 43, there is formed an upper fitting portion 44 comprised of a pair of portions alternately protruding inward from the upper support portion 41. More specifically, the upper fitting portion 44 is constituted by a front protruding portion 46 and a rear protruding portion 47 which are displaced with respect to each other in the sliding direction, and at the same time displaced in a front-rear direction by the thickness of the cutter blade 33.

On the other hand, the lower support portion 42 is formed with a lower fitting portion 45 protruding inwardly from the distal end portion thereof, and at a portion backward of the lower fitting portion 45, the lower support portion 42 is continuous with the lower end of the cutter face-receiving member 38 such that the lower end and the lower fitting portion 45 are alternately arranged. More specifically, the lower fitting portion 45 and the cutter face-receiving member 38 are formed in a manner such that they are displaced with respect to each other in the sliding direction, and at the same time displaced in the front-rear direction by the thickness of the cutter blade 33. Further, the lower fitting portion 45 and the front protruding portion 46 of the upper fitting portion 44 are displaced in the front-rear direction with respect to each other, and the lower fitting portion 45 and the rear protruding portion 47 of the upper fitting portion 44 are positioned at the same location in the front-rear direction. Further, the pair of support portions 41, 42 have guide projections 48, 48, respectively. Each of the guide projections 48, 48 has a semispherical shape in cross section, and is formed in a manner protruding from the outer end surface of the support member. The guide projections 48, 48 enable the cutter holder 34 to be brought into line contact with the pair of slide supporting plate portions 26, 26 of the cutter-supporting frame 24 when the cutter holder 34 is slidingly moved, whereby it is possible to reduce frictional force produced during the sliding operation of the cutter holder 34.

The cutter face-receiving member 38 has a lower half portion thereof formed continuous with the lower support portion 42 such that it has a shape of a parallelogram and an upper half portion thereof formed continuous with the proximal end portion of the upper support portion 41 such that it has a shape of a triangle. Thus, the lower support portion 42 is given resilience such that it can be bent against the resilience thereof when it receives some external force. This makes it possible to smoothly attach and remove the cutter blade 33 to and from the cutter holder 34. Further, when the cutter blade 33 is attached to the cutter holder 34, the cutter face-receiving member 38 receives one of the front and rear side surfaces of the cutter blade 33, and the other side surface of the cutter blade 33 and the outer surface of the holder body 35 become approximately flush with each other.

According to the above construction, the cutter blade 33 is held between the pair of support portions 41, 42 resiliently in the vertical direction in a manner such that upper and lower end portions of the cutter blade 33 are fitted or sandwiched from the front and rear surface sides alternately in the sliding direction, and has the one of the front and rear side surfaces thereof supported by the cutter face-receiving member 38. In this state, the cutter blade 33 is prevented from falling off the cutter holder 34 due to an excessive sliding motion, a shock or impact applied thereto, or the like.

The input portion 37 is comprised of an input portion body 50 projecting rearward (toward the rear wall the casing 2) generally in the shape of the letter "U" from the tail end of the holder body 35, a pin-holding plate 51 horizontally protruding from a vertically intermediate portion of the input portion body 50 backward in the sliding direction, an arm-engaging pin 52 erected on the pin-holding plate 51, and a spring-engaging portion 53 in the form of a round bar, horizontally extending from a vertically intermediate portion of the input portion body 50 forward in the sliding direction. The input portion body 50 has an arm-abutting surface 54 formed on the arm-engaging pin side, and in an intermediate portion of the arm-abutting surface 54, i.e. in an intermediate portion of the cutter holder 34, there is formed a protruding contact portion 55 on which the pivot arm 32 abuts and applies an urging force thereto. Further, the arm-engaging pin 52 is engaged with an engaging groove 78 formed in a distal end portion of the pivot arm 32 (see FIG. 2).

With this configuration, when the pivot arm 32 is pivotally moved toward the cutter 16, the urging force is transmitted from the pivot arm 32 to the contact portion 55, whereby the cutter holder 34 is slidingly moved forward to advance the cutter blade 33 toward the printing tape T. At this time, prior to the sliding motion of the cutter 16, the tape-retaining member 31 is advanced to a pushing position toward the printing tape T. Further, inversely, when the pivot arm 32 is pivotally moved toward the manual operation lever 12, a force is transmitted from the pivot arm 32 to the arm-engaging pin 52, whereby the cutter holder 34 is slidingly moved backward to withdraw the cutter blade 33 such that it moves away from the printing tape T. After that, the tape-retaining member 31 is moved away from the printing tape T to return to a release position.

The spring-engaging portion 53 extends forward from the input portion body 50 with predetermined gaps from the holder body 35, and has a spring 56 mounted from a distal end thereof. Further, the holder body 35 has a pair of hook-receiving portions 39, 39 for engagement with hooks 62, 62 of the tape-retaining member 31, referred to hereinafter, on upper and lower rear ends of the holder body 35 on opposite sides of the spring-engaging portion 53. As described in detail hereinafter, the cutter 16 and the tape-retaining member 31 are not only slid as a unitary member but also engaged with each other in a mutually slidable manner. In the mutual sliding, a forward sliding motion of the cutter 16 with respect to the tape-retaining member 31 is controlled by engagement between the hook 62 and the hook-receiving portion 39. That is, the cutter holder 34 is engaged with the tape-retaining member 31 via the spring-engaging portion 53 and the spring 56 mounted thereon and the pair of hook-receiving portions 39, 39 in a state urged forward in the sliding direction.

Figure 6:
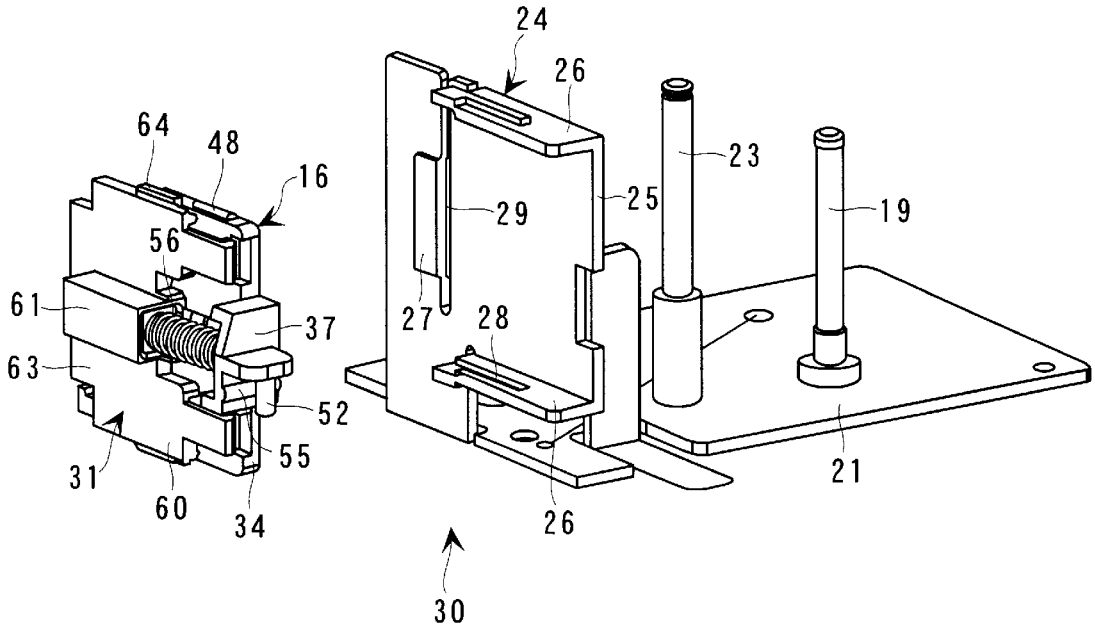
FIG. 6 is an exploded perspective view showing the structure of the cutter and component parts associated therewith of the tape cutting mechanism.
Figure 7:
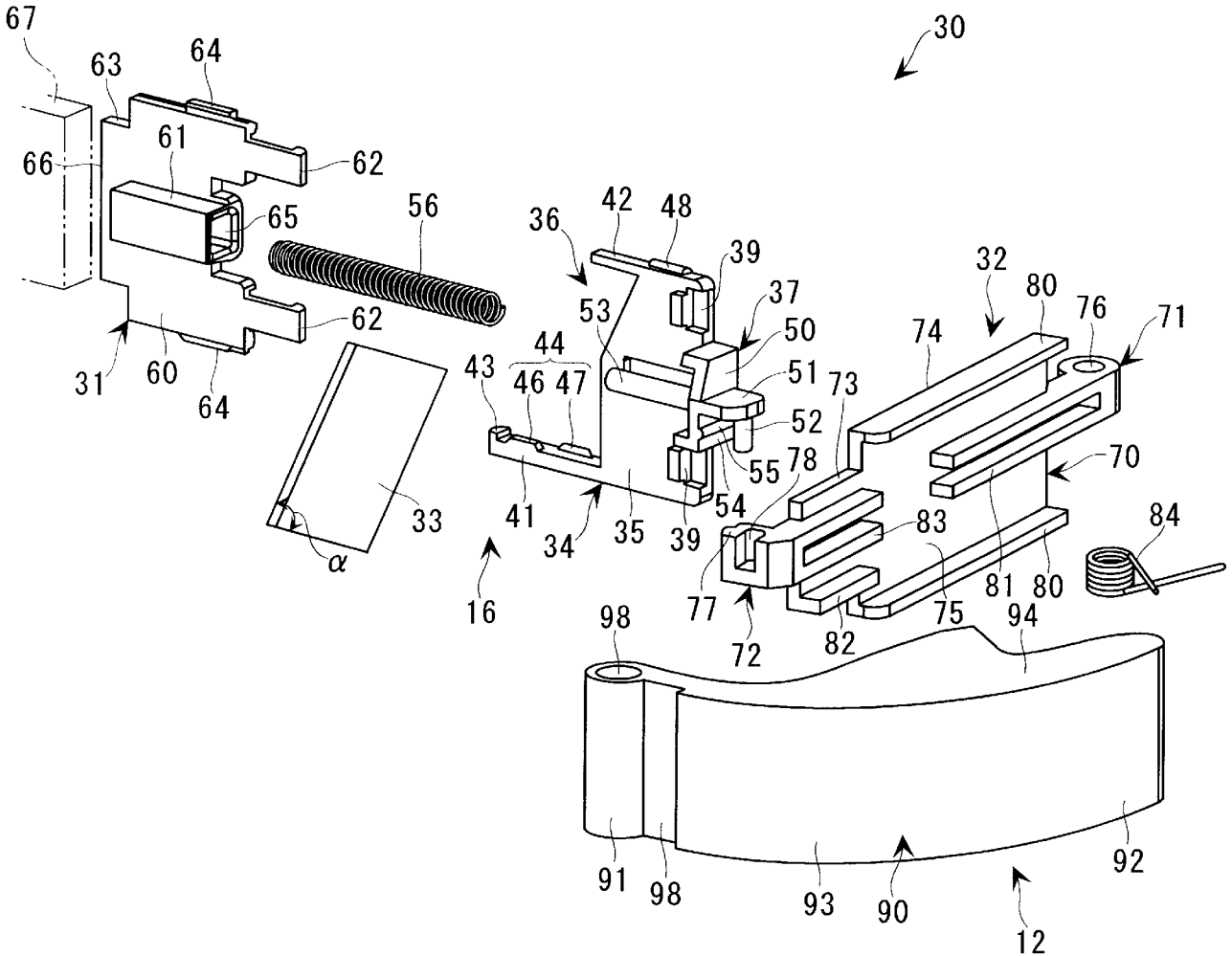
FIG. 7 is an exploded perspective view of the tape cutting mechanism.
Figure 8A:
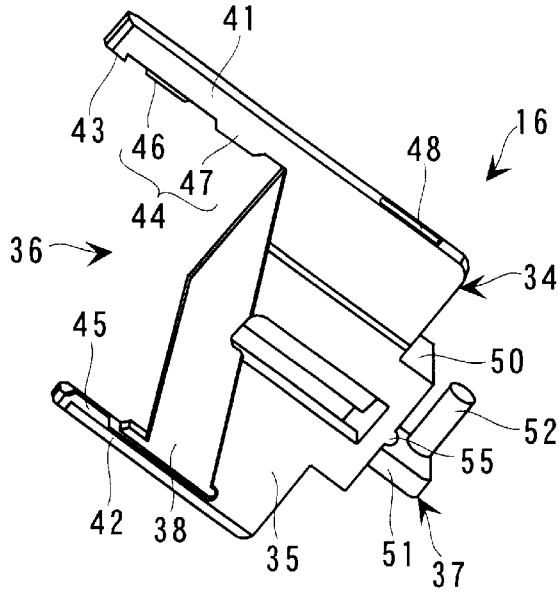
FIGS. 8A to 8C are perspective views each showing the structure of the cutter.
Figure 8B:
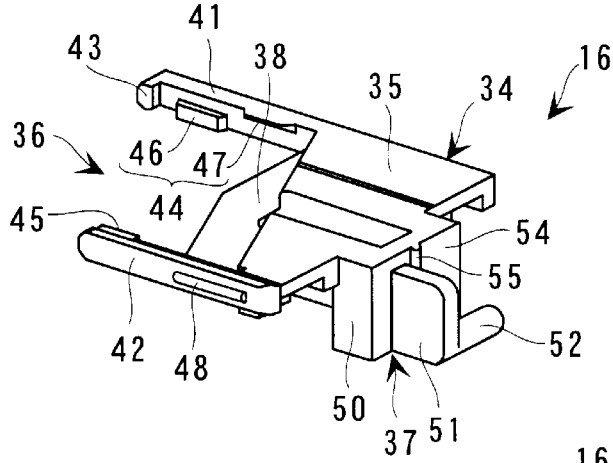
Figure 8C:
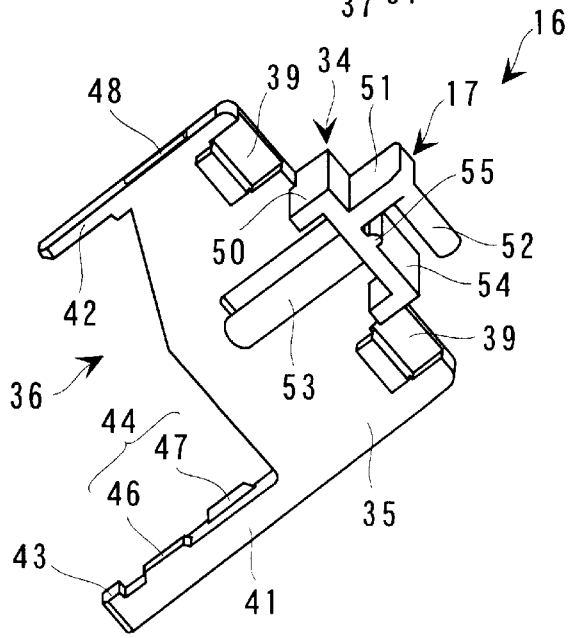
Figure 9A:
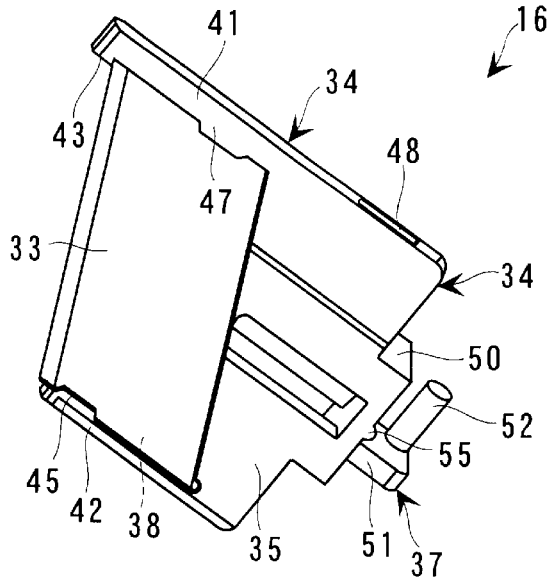
FIGS. 9A to 9C are perspective views each showing the structure of the cutter.
Figure 9B:
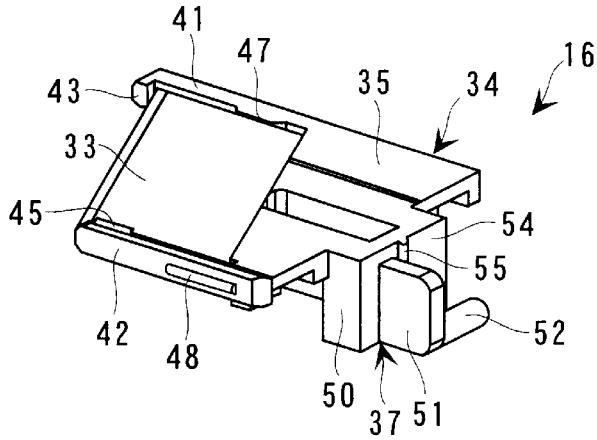
Figure 9C:
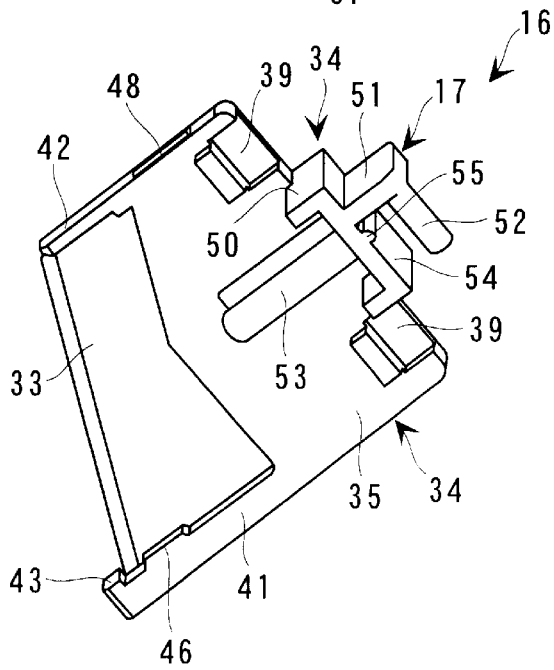

As shown in FIGS. 6 and 7, the tape-retaining member 31 is comprised of a member body 60, a spring-holding portion 61 having a shape of a rectangular parallelepiped, projecting from an intermediate portion of a rear-side surface of the member body 60, the aforementioned pair of upper and lower hooks 62, 62 extending from upper and lower end portions of the member body 60 horizontally and backward in the sliding direction, and a tape-retaining face portion 63 formed by reducing the width (i.e. height) of a forward end portion of the member body 60. The member body 60 is configured to have substantially the same height as that of the cutter holder 34, and engaged with the holder body 35 in a manner such that a front wall thereof and the rear wall of the holder body 35 match with each other.

The spring-holding portion 61 includes a predetermined holding space 65 having one end portion thereof open in a manner corresponding to the spring-engaging portion 53 of the cutter holder 34. The spring-engaging portion 53 and the spring 56 mounted thereon are inserted into the holding space of the spring-holding portion 61 to relatively urge the tape-retaining member 31 forward in the sliding direction. The hooks 62 formed in a manner corresponding to the hook-receiving portions 39 of the cutter holder 34 are hooked on the hook-receiving portions 39 to maintain the state of urging the tape-retaining member 31 forward in the sliding direction.

The tape-retaining face portion 63 has a forward end face formed with a planar retaining face 66 which extends vertically in a manner corresponding to a printing tape T having the maximum width. The retaining face 66 is formed to be opposed to an abutment portion 67 formed in the casing 2 such that the retaining face 66 abuts on the abutment portion 67 to thereby stop a forward sliding motion of the tape-retaining member 31. More specifically, the tape-retaining member 31 is configured such that it can be moved to and moved away from the printing tape T between a retaining position and a release position. The retaining position is a position where after performing a forward sliding motion, the tape-retaining member 31 holds the printing tape T between the same and the abutment portion 67 and stops for starting a cutting operation. The release position is a position where the tape-retaining member 31 is away from the abutment portion 67 when the cutting operation is completed. Further, the abutment portion 67 has an end face thereof arranged such that the end face is approximately flush with an end face of the raised portion 27 (passing slit 29) of the cutter-supporting frame 24 to cause the printing tape T held as above to take a straight flat shape between the abutment portion 67 and the raised portion 27.

Further, the tape-retaining member 31 has a pair of upper and lower guide members 64, 64 protruding from respective upper and lower end faces thereof. The upper and lower guide members 64, 64 are slidably engaged with the pair of guide grooves 28, 28 formed in the pair of slide supporting plate portions 26, 26 of the cutter-supporting frame 24. With this configuration, the tape-retaining member 31 has the upper and lower end faces thereof supported by the cutter-supporting frame 24 such that the tape-retaining member 31 is positioned in the front-rear direction and the sliding motion thereof is guided at the top and the bottom. Further, when the pair of upper and lower guide members 64, 64 abut against backward ends of the pair of guide grooves 28, 28 in the sliding direction, a returning sliding motion of the tape-retaining member 31, and hence a returning sliding motion of the cutter 16 are limited.

Now, the cutting operation by the cutter 16 and the tape-retaining member 31 for cutting off a printed portion of the printing tape T will be briefly described. When the pivot arm 32 transmits a pushing force from the manual operation lever 12 to the tape cutting mechanism 30, the tape-retaining member 31 starts to be slidingly moved forward together with the tape-retaining member 31. The tape-retaining face portion 63 of the tape-retaining member 31 is slightly protruded in the sliding direction (cutting direction) with respect to a forward end of the cutter blade 33, and when the tape-retaining member 31 is slid forward, the tape-retaining member 31 abuts against the abutment portion 67 in a manner urgingly sandwiching the printing tape T before the cutter blade 33 abuts against the printing tape T. This prevents the tape-retaining member 31 from being further slid, but allows the cutter 16 to move further forward to thereby cut the printing tape T while compressing the spring 56.

In the above process, the cutter blade 33 progressively cuts the printing tape T downward in the direction of the width of the tape T by force-cutting to cut off a printed portion of the tape T. At this time, on a downstream side in the direction of feed of the printing tape T, the tape-retaining member 31 firmly holds the printing tape T by the urging force of the compressed spring 56, thereby making it possible to cut through the printing tape T with stability. When the cutting edge of the cutter blade 33 is moved further than a position of the passing slit 29 to completely cut off the printed portion of the printing tape T, the manual operation lever 12 abuts against the casing 2 to thereby prevent a further cutting operation.

Now, when the user releases the manual operation lever 12 to let it return to its original position, the cutter 16 starts a returning operation in advance of that of the tape-retaining member 31. When the hooks 62 and the hook-receiving portions 39 are engaged with each other, the cutter 16 starts to be slid in a returning direction along with the tape-retaining member 31 by the urging force of a coiled spring 84, referred to hereinafter. This sliding motion of the cutter 16 in the returning direction stops when the pair of upper and lower guide members 64, 64 of the tape-retaining member 31 reach backward ends of the pair of guide grooves 28, 28 of the cutter-supporting frame 24. Further, at a time point the tape-retaining member 31 moves away from the printing tape T, the printing tape T (label) falls down from the tape exit 15 by its own weight.

Figure 10:
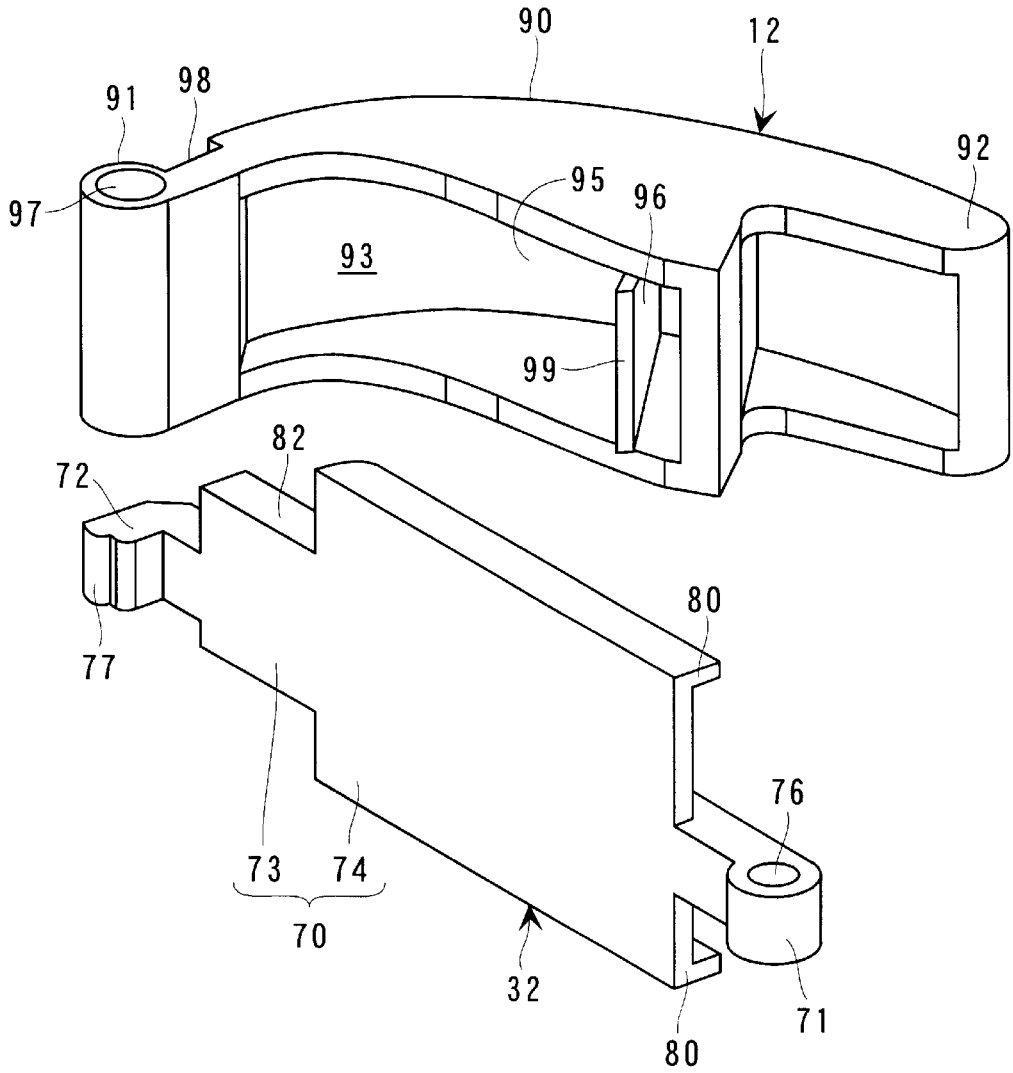
FIG. 10 is a perspective view of a manual operation lever and a pivot arm of the tape cutting mechanism.
Figure 11:
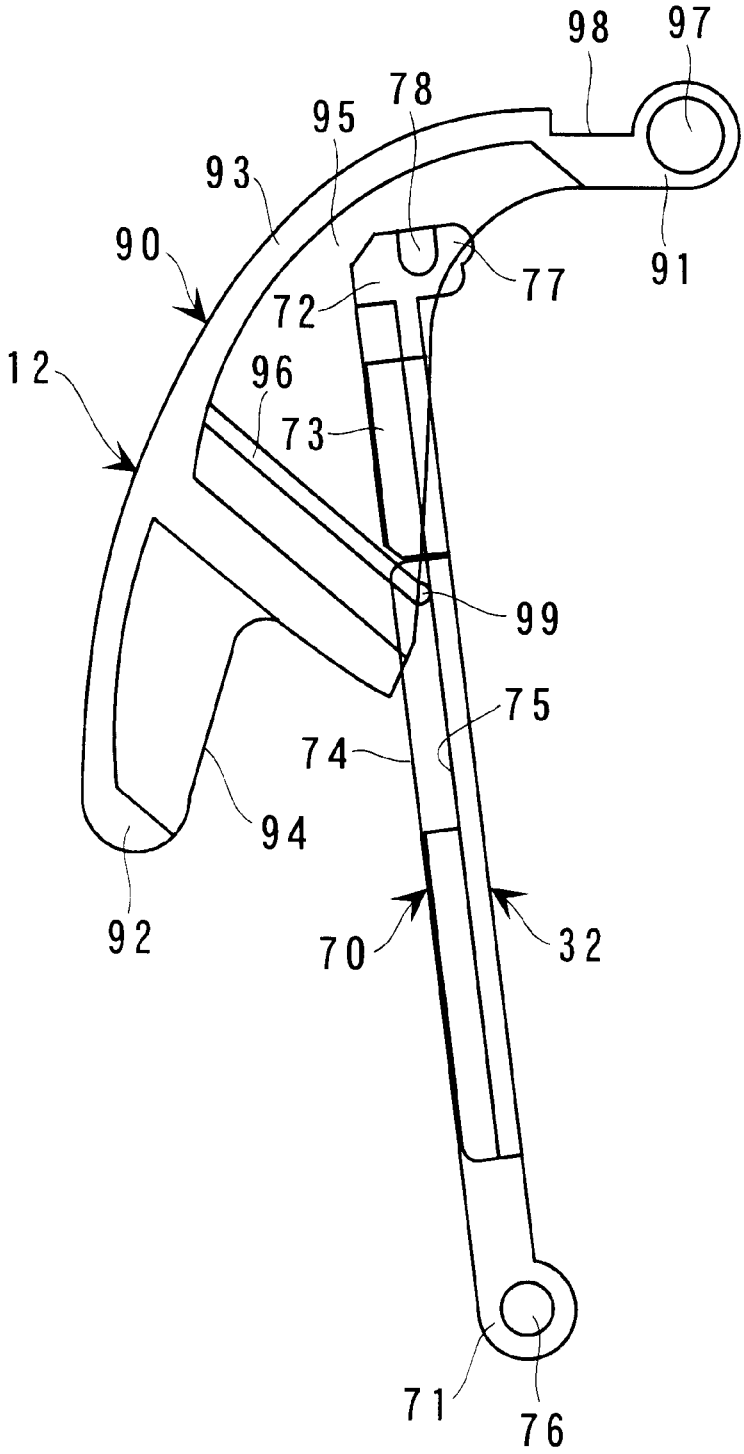
FIG. 11 is a plan view of the manual operation lever and the pivot arm of the tape cutting mechanism.
Figure 12:
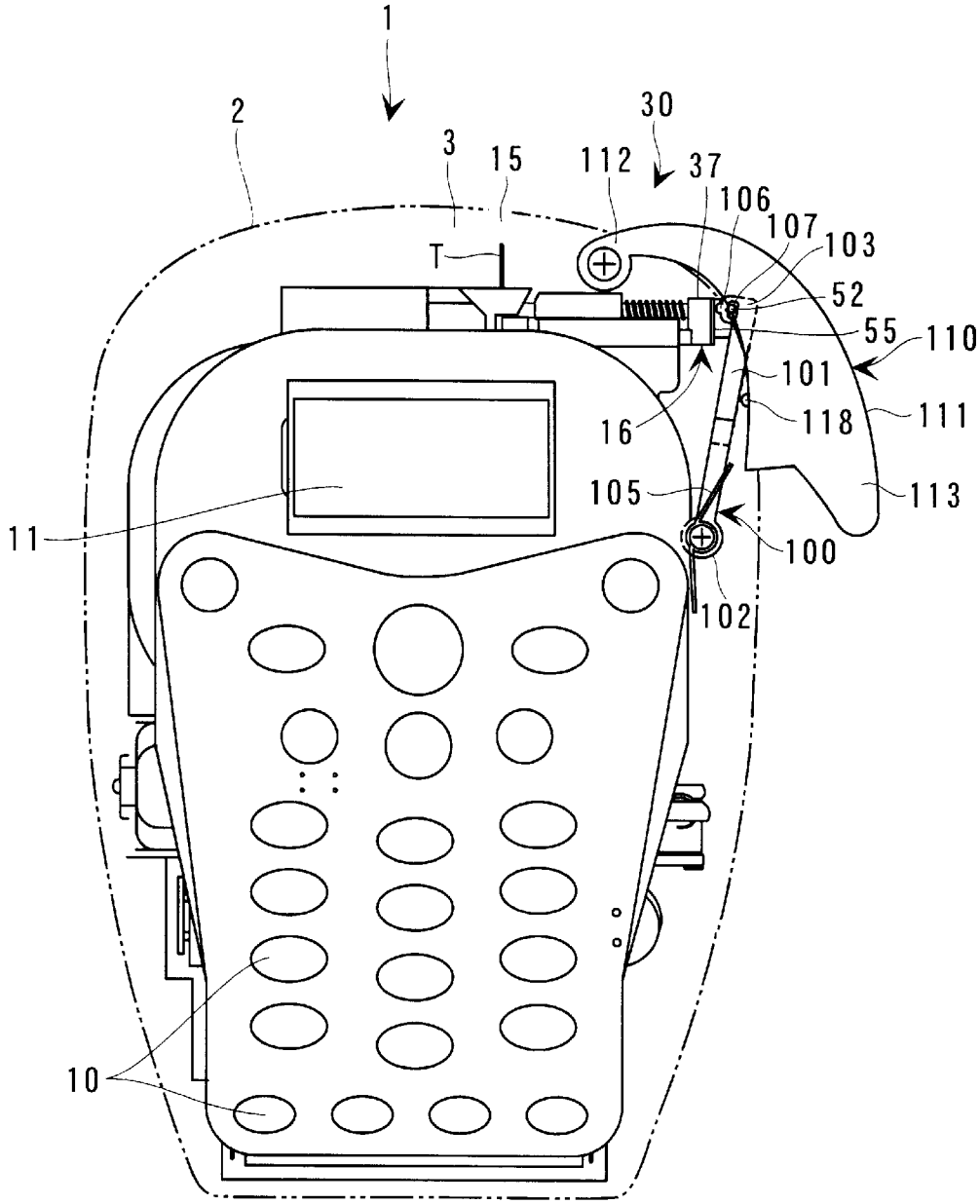
FIG. 12 is a plan view of a tape printing apparatus incorporating a tape cutting mechanism according to a second embodiment of the invention with a casing thereof omitted, as viewed from a top side.
Figure 13:
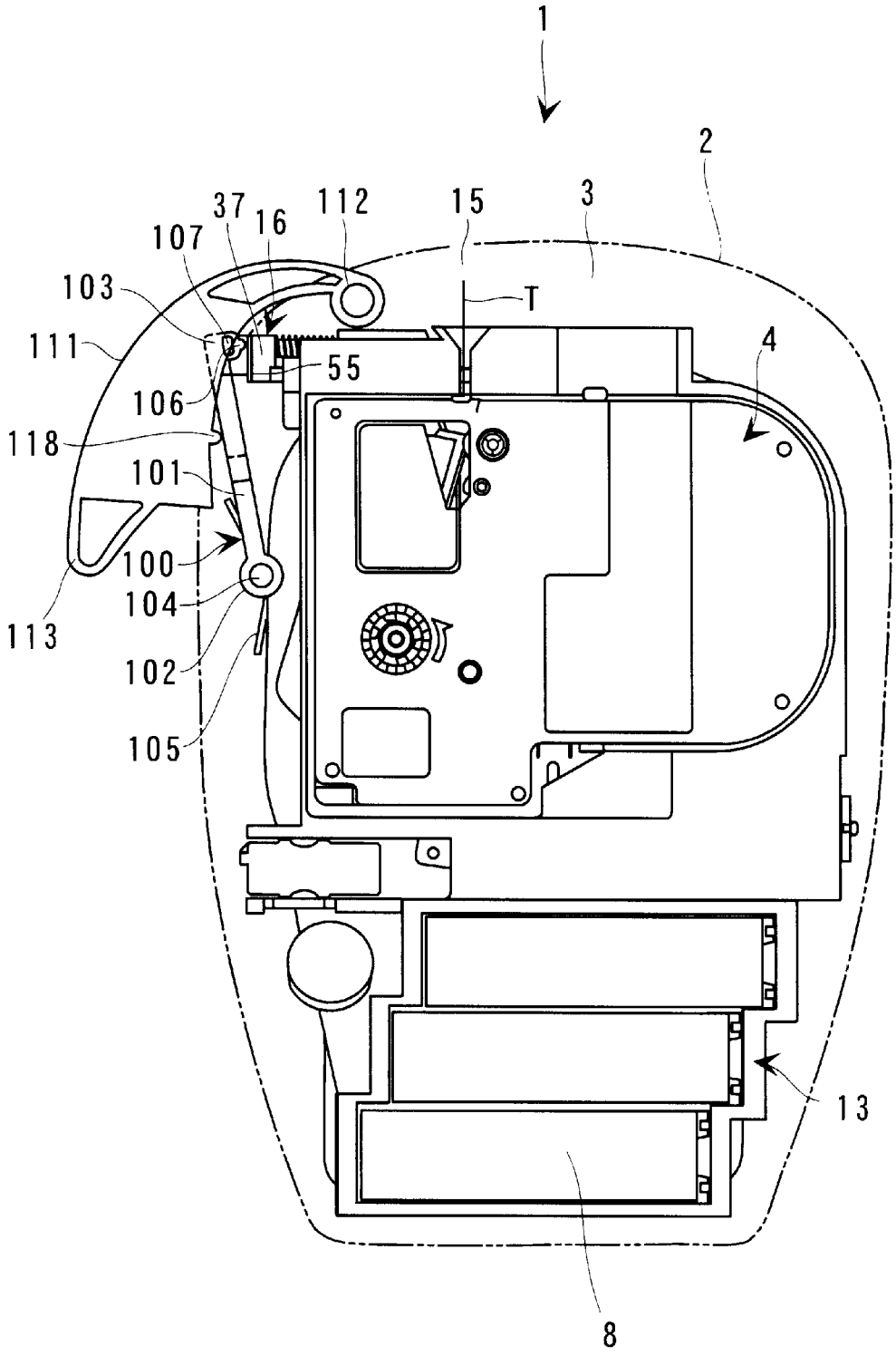
FIG. 13 is a bottom view of the FIG. 12 tape printing apparatus with the casing thereof omitted, as viewed from a bottom side.
Figure 14A:
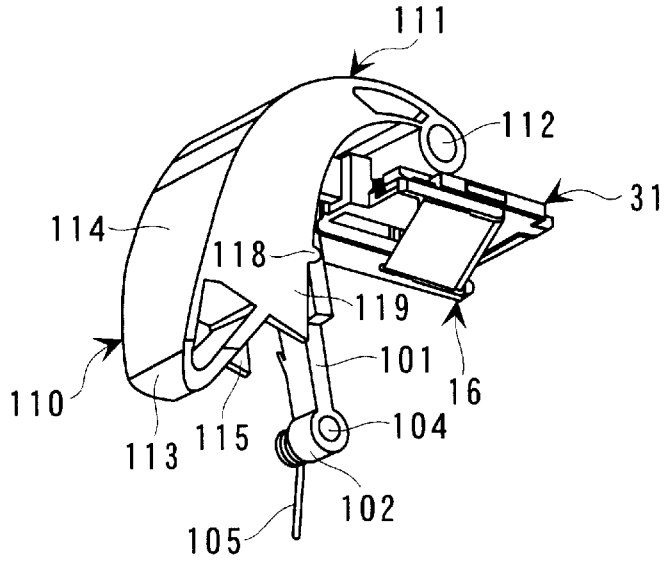
FIGS. 14A to 14C are perspective views each showing the structure of the tape cutting mechanism according to the second embodiment.
Figure 14B:
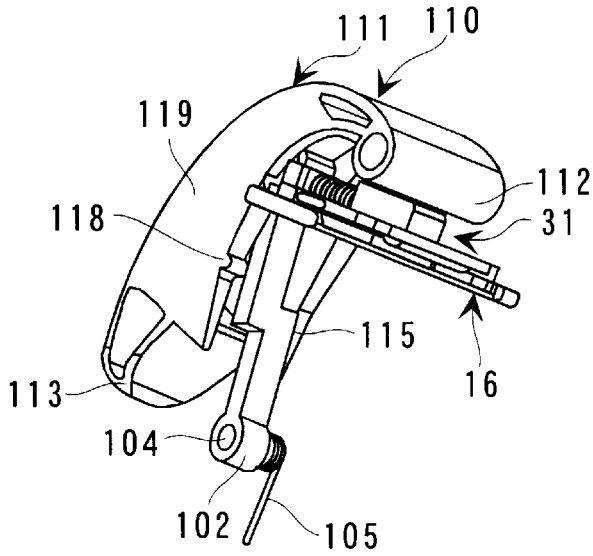
Figure 14C:
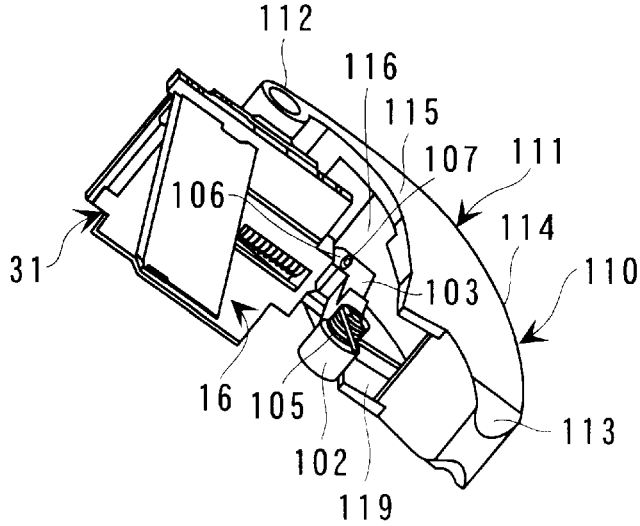
Figure 15A:
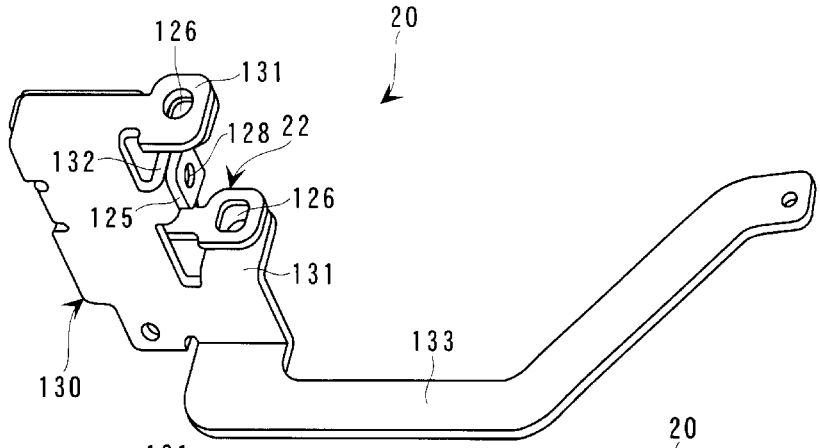
FIGS. 15A to 15C are perspective views each showing the structure of a head unit and component parts associated therewith.
Figure 15B:
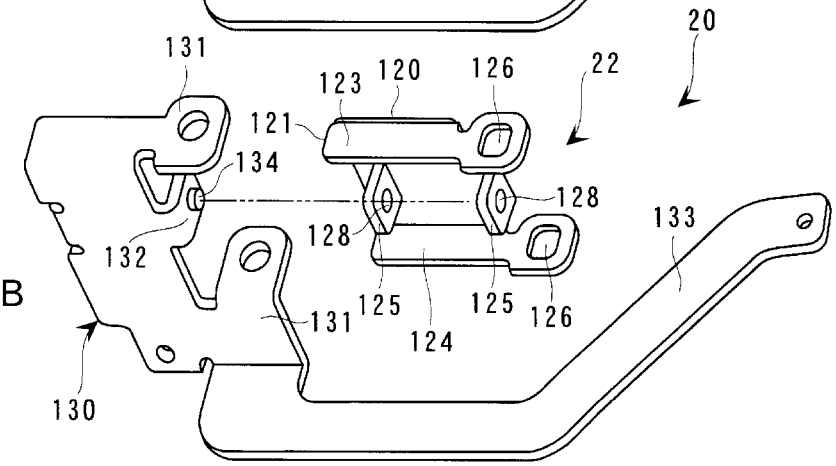
Figure 15C:
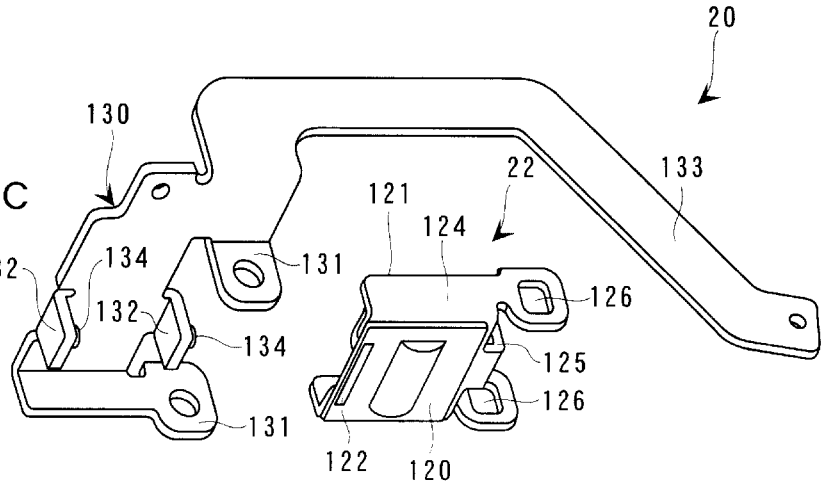

Next, the pivot arm 32 and the manual operation lever 12 will be described with reference to FIGS. 7, 10, and 11. As shown in the figures, the pivot arm 32 is comprised of an arm body 70 extending in a direction substantially orthogonal to the direction of sliding of the cutter 16, an arm-pivoting portion 71 extending frontward from the arm body 70, and having a proximal end formed with a shaft hole 76 extending therethrough, and an engaging/abutting portion 72 extending rearward from the arm body 70 for engagement with the input portion 37 of the cutter 16. The arm body 70 is formed by a front body 74 having a wider width, and a rear body 73 continuous with the front body 74 and having a narrower width.

The front body 74 is formed with a pair of reinforcing ribs 80, 80 formed by bending upper and lower end portions toward an outer side, and a shaft-side rib 81 extending from the arm-pivoting portion 71 along a vertically intermediate portion of the outer surface in an outwardly protruding manner. On the other hand, the rear body 73 has a horizontal member 82 having an upper end portion thereof bent toward an outer side, and an engagement-side rib 83 extending from the engaging/abutting portion 72 along a vertically intermediate portion of an outer surface of the rear body 73 in an outwardly protruding manner. The engagement-side rib 83 is formed such that it is alignment with the shaft-side rib 81 while opposed ends of the engagement-side rib 83 and the shaft-side rib 81 are spaced from each other by a predetermined distance. Formed in this space on the outer surface of the front body 74 is a lever-operating surface 75 formed flat for receiving an urging portion 99, referred to hereinafter, of the manual operation lever 12. It should be noted that the arm body 70 including the lever-operating surface 75 is reinforced by the pair of reinforcing ribs 80, 80.

The shaft hole 76 of the arm-pivoting portion 71 is rotatably fitted on a shaft pin arranged on a right-side portion (frame) of the main unit 3, and the pivot arm 32 is supported such that it can be pivotally moved about the shaft pin. A torsion coiled spring 84 is mounted between the arm-pivoting portion 71 and the main unit 3 by being wound around the shaft pin. The torsion coiled spring 84 has one end thereof engaged with the shaft-side rib 81 of the arm body 70, and the other end thereof engaged with the frame of the main unit 3. This makes it possible to urge the pivot arm 32 in a direction in which it is moved away from the cutter 16 (toward the manual operation lever 12).

The engaging/abutting portion 72 is slightly bent inward from the distal end portion of the arm body 70, and the bent distal end portion is formed with an abutting portion 77 for abutting against the contact portion 55 of the input portion body 50, and the aforementioned engaging groove 78 which is vertically bottomed and open rearward. The engaging groove 78 has a shape which is slightly elongated in the front-rear direction for loose engagement with the arm-engaging pin 52. With this configuration, the arm-engaging pin 52 of the pivot arm 32 can be very slightly displaced in the engaging groove 78 without difficulty to thereby smoothly transmit a force to the cutter 16 which is moving toward or away from the printing tape T.

Therefore, when the pivot arm 32 is pivotally moved toward the cutter 16 against the urging force of the torsion coiled spring 84, the arm-engaging pin 52 causes the engaging groove 78 to slide relatively slightly to bring the abutting portion 77 into abutment with the contact portion 55, thereby urging the cutter holder 34. Inversely, when the pivot arm 32 is pivotally moved toward the manual operation lever 12 by the restoring action of the torsion coiled spring 84, the arm-engaging pin 52 causes the engaging groove 78 to slide relatively slightly to move the abutting portion 77 away from the contact portion 55. Then, the pivot arm 32 returns to its original position, and the manual operation lever 12 as well is caused to return to its wait position as its original position, by the forced received via the urging portion 99.

The manual operation lever 12 is formed by a lever body 90 bent along a side surface of the casing 2, a lever-pivoting portion 91 at a rear end portion of the lever body 90, through which vertically extends a shaft hole 97, and a lever operation portion 92 protruding from a front end portion of the lever body 90 in the form of a tongue. The lever-pivoting portion 91 is arranged at a location between and close to the tape exit 15 and the input portion 37 of the cutter 16, and the shaft hole 97 thereof is rotatably fitted on a shaft pin arranged at a rear-right corner of the main unit 3. Thus, the manual operation lever 12 is configured to be pivotally moved about the shaft pin.

The lever operation portion 92 is spaced from a right-side surface of the casing 2 by a predetermined distance to form a gap, and the pivotal operation thereof can be performed by the user drawing the portion 92 inwardly toward him with a finger placed thereon such that the portion 92 fills the above gap. Further, the lever operation portion 92 is constructed such that a left-side surface thereof abuts against part of the main unit 3 within the casing 2 when the manual operation lever 12 is pivotally moved in the direction of the inside of the apparatus (toward the cutter 16). In this state, the printing tape T is completely cut through. That is, the part of the main unit 3 within the casing 2 is used as a stopper for limiting pivotal motion of the manual operation lever 12.

It should be noted that the casing 2 has a rear-right side portion partially cut away by a depth equal to one stroke of the manual operation lever 12 such that the lever body 90 is pivotally moved to partially sink into the main unit 3. Further, the manual operation lever 12 is outwardly urged by the torsion coiled spring 84 via the pivot arm 32, but its pivotal motion further outward of the wait position is restricted by abutment of a stepped or recessed portion 98 between the lever body 90 and the lever-pivoting portion 91 against the cut-away portion of the casing 2.

Figure 4:
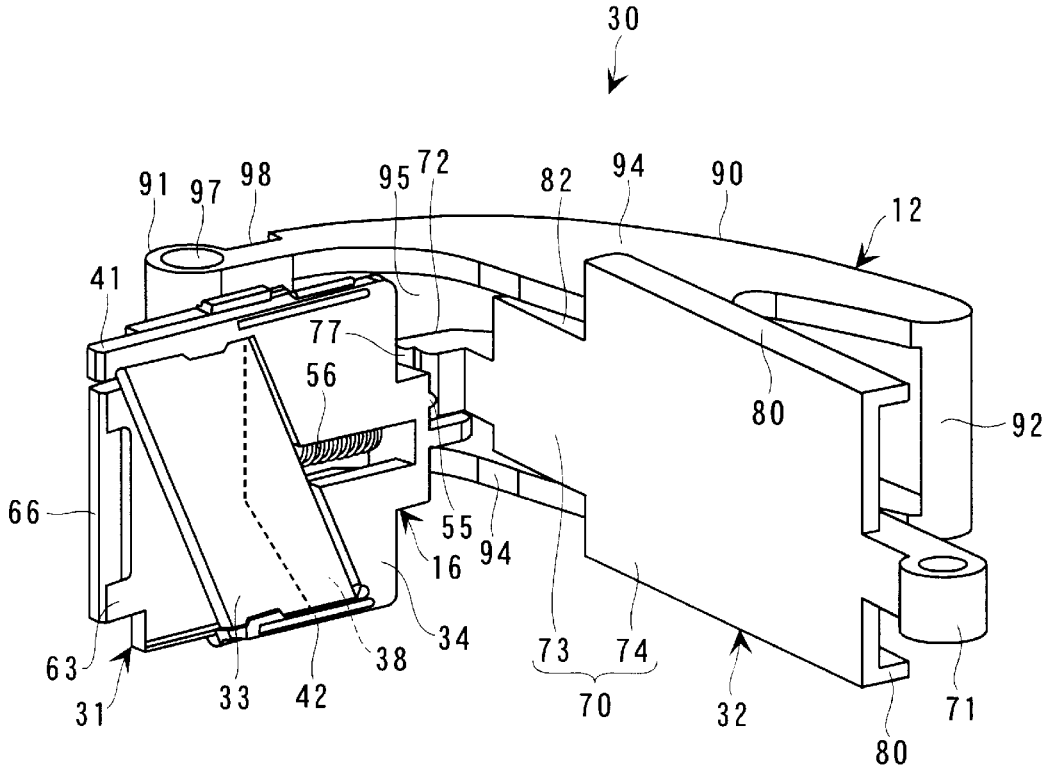
FIG. 4 is a perspective view of the tape cutting mechanism on enlarged scale.

The lever body 90, together with an outer plate 93 continuous with a right-side surface of the lever operation portion 92, and upper and lower end plates 94 which are continuous with the outer plate 93 and separated vertically from each other, and at the same time positioned such that the end plates 94 are sandwiched between the pair of reinforcing ribs 80, 80 of the pivot arm 32, defines an arm-accommodating space 95 inside the lever body 90 for covering the engaging/abutting portion 72 and the rear body 73 of the arm body 70 (see FIG. 4). Further, the lever body 90 has an urging plate 96 formed at an intermediate location in the front-rear direction, i.e. an approximately intermediate location between the lever-pivoting portion 91 and the lever operation portion 92. The urging plate 96 extends from an inner surface of the outer plate 93 to project out of the arm-accommodating space 95. A projecting end of the urging plate 96 constitutes the urging portion 99 which abuts on the lever-operating surface 75 of the pivot arm 32 to urge the same toward the cutter 16. In short, the manual operation lever 12 has the lever-pivoting portion 91 used as a fulcrum, the lever operation portion 92 as a force point, and the urging portion 99 as a point of action.

As described hereinabove, according to the tape cutting mechanism 30 of the present embodiment, the cutting operation of the cutter 16 via the manual operation lever 12 is carried out via the pivot arm 32, and hence even if the center of the pivotal motion of the manual operation lever 12 is arranged close to the input portion 37 of the cutter 16, a component force is not applied to the printing tape T and the cutter blade 33 respectively when the printing tape T is cut through. This makes it possible to make neat a cutting end face of the printing tape T as well as improve the durability of the cutter blade 33. Further, this also makes it possible not only to improve the operability of the manual operation lever 12 by holding the tape printing apparatus with his hands but also to make the apparatus compact in size.

Next, a second embodiment of the invention will be described with reference to FIGS. 12 to 14C. The following description is given mainly concerning the differences between the pivot arm and the manual operation lever of the first embodiment and those of the second embodiment. A pivot arm 100 according to the second embodiment extends a shorter distance in a direction substantially orthogonal to the direction of sliding of the cutter 16, than the pivot arm of the first embodiment. The pivot arm 100 is comprised of an arm body 101 which extends in the front-rear direction with a front portion thereof lowered by one step than its rear portion, an arm-pivoting portion 102 formed at a proximal end of the pivot arm frontward of the arm body 101, with a shaft hole 104 vertically extending therethrough, and an engaging/abutting portion 103 which is formed at a distal end of the pivot arm, rearward of the arm body 101, in a manner bent and protruded inwardly.

The arm-pivoting portion 102 has a shaft hole 104 for being pivotally fitted on a shaft pin arranged at a right-side portion of the main unit 3. The pivot arm is arranged such that it is pivotally moved about the shaft pin 100. The shaft pin has a torsion coiled spring 105 fitted thereon, and the pivot arm 100 is mounted to the main unit 3 in a state urged toward the manual operation lever 110 whereby the pivot arm 100 is kept away from the cutter 16.

The engaging/abutting portion 103 has an inner end portion formed with an abutting portion 106 which abuts against the input portion 37 of the cutter 16 for urging the contact portion 55 thereof. The engaging/abutting portion 103 has a central portion formed with an engaging groove 107 which is elongated in the front-rear direction and at the same time vertically extends through the engaging/abutting portion 103. The engaging groove 107 is loosely engaged with the arm-engaging pin 52. The arm body 101 is constructed such that an urging portion 118 of the manual operation lever 110 pivotally moved abuts against a surface of a portion between the engaging/abutting portion 103 and the arm-pivoting portion 102, that is, a portion of the pivot arm 100 approximately intermediate in the front-rear direction and lowered by one step than the rear portion thereof.

The manual operation lever 110 is comprised of a lever body 111, a lever-pivoting portion 112 at a rear end, and a lever operation portion 113 at a front end, all of which are integrally formed as a unitary member. The lever body 111, together with an outer plate 114 continuous with a right-side surface of the lever operation portion 113, and upper and lower end plates 115, 119 continuous with the outer plate 114 and separated vertically from each other, defines an arm-accommodating space 116 inside the lever body 111 for covering the engaging/abutting portion 103 and part of a rear portion of the arm body 101. Further, the lever body 111 has a linear urging portion 118 formed in a manner protruding from an inner end face of the lower end plate 119, at an intermediate location of the manual operation lever 110 in the front-rear direction, i.e. at an approximately intermediate location between the lever-pivoting portion 112 and the lever operation portion 113. Thus, the manual operation lever 110 has the lever-pivoting portion 112 serving as a fulcrum, the lever operation portion 113 as a force point, and the urging portion 118 as a point of action.

As described above, according to the present embodiment, since the intermediate portion (urging portion 118) of the manual operation lever 110 is urged against the intermediate portion of the pivot arm 100, it is possible to transmit a pivotally moving force of the manual operation lever 110 from the pivot arm 100 to the cutter 16, thereby applying the force to a cutting operation with least reduction thereof. Therefore, the lever can be operated with a light force, thereby further enhancing the operability of the manual operation lever 110.

Next, the construction of the head unit 20 and component parts associated therewith will be described with reference to FIG. 3 and FIGS. 15A to 15C. The head unit 20 includes the print head 22, and a head-urging member 130 for urging the print head 22, and is arranged on the base frame 21. More specifically, the base frame 21 has the head-supporting shaft 23 (FIG. 5) extending perpendicularly therefrom, and the print head 22 and the head-urging member 130 are vertically supported by the head-supporting shaft 23 in a pivotally movable manner.

The print head 22 is comprised of a head body 120 and a head holder 121 for supporting the head body 120. The head body 120 has a large number of heating elements 122 vertically arrayed on an end thereof positioned farthest from the head-supporting shaft 23. The length of the array of the heating elements 122, that is, the height of the head body 120 corresponds to a printing tape T having the largest width (18 mm).

The head holder 121 is pivotally connected to the head-urging member 130 via a vertically intermediate portion thereof, and in this state, loosely mounted on the head-supporting shaft 23 by a pair of upper and lower mounting holes 126, 126 formed in respective end portions of an upper supporting plate 123 and a lower supporting plate 124. Each mounting hole 126 is a slot elongated in a left-right direction. Further, on a back surface side of the vertically intermediate portion of the head holder 121, a pair of supporting members 125, 125 spaced from each other in the front-rear direction are formed in a protruding manner, by cutting and bending portions of the head holder 121. The pair of supporting members 125, 125 each have a central portion formed with a supporting hole 128 extending therethrough. The head holder 121 is connected to the head-urging member 130 via the pair of supporting holes 128, 128.

The head-urging member 130 is pivotally supported by the head-supporting shaft 23 via a pair of upper and lower shaft-receiving portions 131, 131. The head-urging member 130 has a pair of brackets 132, 132 which are spaced from each other in the front-rear direction, formed in a protruding manner on a front surface side of a vertically intermediate portion thereof. The pair of brackets 132, 132 each have a supporting projection 134 formed (by press molding) toward the head-supporting shaft 23 in a manner projecting from a central portion thereof. The pair of supporting projections 134, 134 have shapes substantially identical to those of the pair of supporting holes 128, 128, and are fitted in the pair of supporting holes 128, 128, respectively. This makes it possible to connect the head-urging member 130 and the print head 22 to each other with their positions being restricted mutually. In this state, when the head-urging member 130 is pivotally moved to bring the print head 22 into intimate contact with the platen, the print head 22 can be pivotally moved about an axis extending through supporting projections 134 (supporting hole 128), and an urging force is transmitted from the pair of supporting projections 134, 134 to the pair of supporting holes 128, 128.

The head-urging member 130 has a head arm 133 horizontally extending from a lower end portion thereof. The head arm 133 has a distal end portion extending to a side portion of the base frame. When the lower casing 7 of the casing 2 is attached to the intermediate casing 6, the head arm 133 is pushed toward the print head 22 via a link mechanism, not shown, and the head-urging member 130 is pivotally moved about the head-supporting shaft 23 to urge the print head 22 toward the platen (printing wait state). On the other hand, when the lower casing 7 is detached, the above operating procedure is followed in reverse, and the head-urging member 130 is pivotally moved in the reverse direction via the link mechanism, not shown, whereby the print head 22 is moved away from the platen.

As described hereinabove, it is possible to connect the print head 22 to the head-urging member 130 by using the pair of supporting projections 134, 134 shaped on the head-urging member 130 by press molding and the pair of supporting holes 128, 128 formed in the print head 22, thereby bringing the print head 22 into intimate contact with the platen. This makes it possible to omit a horizontal pin conventionally used for connecting the print head 22 and the head-urging member 130 to each other. Therefore, it is possible to simplify the construction of the head unit 20 and component parts associated therewith to reduce the number of components, thereby making it possible to reduce the manufacturing costs of the whole tape printing apparatus.

It is further understood by those skilled in the art that the foregoing are preferred embodiments of the invention, and that various changes and modifications may be made without departing from the spirit and scope thereof.

What is claimed is:

1. A tape cutting mechanism for a tape printing apparatus including a casing having a rear side surface, a rear corner portion, and a tape exit formed through the rear side surface, the tape cutting mechanism cutting off a printed portion of a tape-shaped member sent out via the tape exit, in response to a lever operation carried out in a state of the casing being held by hand, the tape cutting mechanism comprising:

a cutter disposed to face the tape exit, for cutting the tape-shaped member from a direction orthogonal thereto, said cutter having an input portion for receiving a force applied thereto;

a manual operation lever pivotally supported in the rear corner portion of the casing, for causing said cutter to perform cutting operation, said manual operation lever having a rear end serving as a center of pivotal motion thereof, a front end serving as a force point to which a force is manually applied by the lever operation, and an intermediate portion located between said rear end and said front end, and extending along the casing from said rear end to said front end in a manner bent frontward; and a pivot arm having one end for being engaged with said input portion of said cutter, another end serving as a center of pivotal motion thereof, and an intermediate portion located between said one end and said another end, and extending from said one end to said the another end in a direction substantially orthogonal to a direction of cutting operation of said cutter, and wherein said manual operation lever has an urging portion formed at said intermediate portion thereof, for abutting on said intermediate portion of said pivot arm and serving as a point of action for pivotally moving said pivot arm.

2. A tape cutting mechanism according to claim 1, wherein said manual operation lever is bent such that said manual lever can be pivotally moved inwardly toward said casing by the force manually applied to said front end thereof.

3. A tape cutting mechanism according to claim 1, further including a stopper against which the front end of said manual operation lever abuts when said cutter has reached a position at which the cutting operation is completed.

4. A tape cutting mechanism according to claim 1, wherein said cutter includes:

a cutter blade that is slid to cut through the tape-shaped member, and a cutter holder having one end having a holding portion for holding said cutter blade, and another end having the input portion engaged with said pivot arm, said cutter holder being configured such that said cutter holder can be slid in the direction of cutting operation.

5. A tape cutting mechanism according to claim 4, wherein the tape-shaped member is sent in a vertical attitude in which the tape-shaped member has a direction of width thereof set to a vertical direction, and wherein said one end of said cutter holder has an upper end portion and a lower end portion at least one of which has resilience, the holding portion of said cutter holder comprising upper support portions formed on said upper end portion on respective front and rear surface sides of said cutter blade alternately along the direction of cutting operation, for holding an upper end of said cutter blade alternately from the front and rear surface sides thereof along the direction of cutting operation, and lower support portions formed on said lower end portion on the respective front and rear surface sides of said cutter blade alternately along the direction of cutting operation, for holding a lower end of said cutter blade alternately from the front and rear surface sides thereof along the direction of cutting operation, said holding portion resiliently holding said cutter blade vertically between said upper end portion and said lower end portion.

6. A tape cutting mechanism according to claim 5, wherein said cutter holder further includes a cutter face-receiving portion which connects a proximal end portion of said upper end portion and a proximal end portion of said lower end portion to each other, and at the same time receives one of the front and rear side surfaces of said cutter blade.

7. A tape cutting mechanism according to claim 4, wherein the casing has an abutment portion formed in a manner opposed to said cutter blade, and wherein the tape cutting mechanism further includes a tape-retaining member that is slid in the direction of cutting operation in a manner interlocked with the lever operation of said manual operation lever to hold the tape-shaped member between the tape-retaining member and the abutment portion of the casing prior to an advancing operation of said cutter blade for cutting through the tape-shaped member, and wherein said tape-retaining member moves away from the abutment portion subsequent to a returning operation of said cutter blade for moving away from the tape-shaped member.

8. A tape cutting mechanism according to claim 7, further including a spring disposed in a manner interposed in the direction of cutting operation between said tape-retaining member and said cutter holder, for urging said tape-retaining member toward the abutment portion, and wherein said tape-retaining member is supported in a manner slidable relative to said cutter holder in a state urged toward the abutment portion.

9. A tape cutting mechanism according to claim 7, wherein said tape-retaining member is arranged at a location downstream with respect to a direction of feed of the tape-shaped member, and outward of said cutter blade.

* * * * *